US010154711B2

(12) United States Patent
Bassan

(10) Patent No.: US 10,154,711 B2
(45) Date of Patent: Dec. 18, 2018

(54) JEWELRY SETTING SYSTEM

(71) Applicant: Vittorio Bassan, New York, NY (US)

(72) Inventor: Vittorio Bassan, New York, NY (US)

( * ) Notice: Subject to any disclaimer, the term of this patent is extended or adjusted under 35 U.S.C. 154(b) by 0 days.

(21) Appl. No.: 15/386,636

(22) Filed: Dec. 21, 2016

(65) Prior Publication Data

US 2018/0168298 A1 Jun. 21, 2018

(51) Int. Cl.
*A44C 17/02* (2006.01)
*A44C 17/04* (2006.01)

(52) U.S. Cl.
CPC ..... *A44C 17/02* (2013.01); *A44C 17/04* (2013.01)

(58) Field of Classification Search
CPC ..... A44C 17/02; A44C 17/04
USPC ..... 63/28
See application file for complete search history.

(56) References Cited

U.S. PATENT DOCUMENTS 755,654 A * 3/1904 Guild ..... A44C 17/02 63/28
1,192,092 A * 7/1916 Morse ..... A44C 17/02 63/28
1,204,916 A 11/1916 Whitehouse
2,132,905 A * 10/1938 Maynier ..... A44C 17/04 63/26
2,200,841 A 5/1940 Gaertner
2,610,385 A * 9/1952 Manne ..... B23P 5/00 29/10
D232,653 S 9/1974 Hess
5,533,364 A 7/1996 Freilich
5,765,398 A * 6/1998 Bardisbanyan ..... A44C 17/046 29/10
6,293,129 B1 9/2001 Gurevich
6,389,846 B1 5/2002 Siebenberg
7,546,749 B1 6/2009 Biren
9,351,546 B2 5/2016 Nevatia
2003/0056536 A1 3/2003 Ubhayakar
2004/0182110 A1 9/2004 Giladi
2005/0188722 A1 9/2005 Nevatia et al.
2009/0090132 A1 4/2009 Dholakiya
2011/0219820 A1 9/2011 Choi

* cited by examiner

*Primary Examiner* — Abigail E Troy
(74) *Attorney, Agent, or Firm* — Michael P. Alexander

(57) ABSTRACT

The present invention provides an improved jewelry stone setting system, having a plurality of stones each having a shared side connected to an adjacent stone to form a setting, and wherein each stone has outer exposed sides connected to form a setting. A single shared prong is placed between adjacent stones at the mid-point of two adjacent girdles to form the setting. A single side prong is placed on each of the exposed sides of each stone at the mid-point of the girdle of the side stone to form the setting. Each of the shared prongs are either open or closed to increase visibility of the stone to the wearer or user. Each of the shared prongs extend from the upper basket to the girdle of the stone to form an open shared prong. Each of the shared prongs extend from the bottom basket to the girdle of the stone to form a closed shared prong. Each of the side prongs are also open or closed to increase visibility of the stones.

15 Claims, 34 Drawing Sheets

The shared prong rises from the bottom basket to the girdle (Closed shared-prong)

Closed Shared prongs

WITH CUSCIONS-SHAPED STONES:

WITH ASSCHERS-CUT STONES:

WITH CUSHION-SHAPE STONES

WITH ASSCHER-CUT STONES

Shared-Prong Cushion

4-Prong Asscher

Shared-Prong Asscher

In multi-layer stone solutions, the shared-prong is placed in the midpoint of the adjacent girdles of each stone and the single prongs are located on the external mid-point of the girdle of each stone.

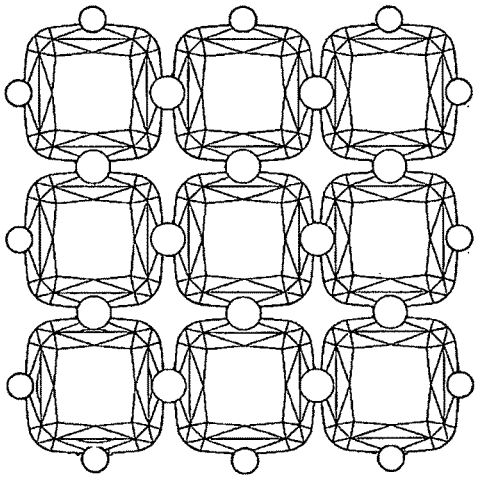

FIG.13

The shared prong rises from the bottom basket to the girdle (Closed shared-prong) or from the upper basket to the girdle (Opened shared-prong). When the Shared prong is closed, the side prongs can also be open. See Image below:

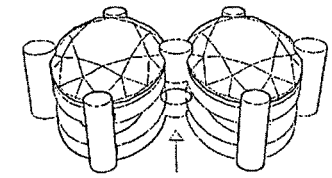

FIG.14

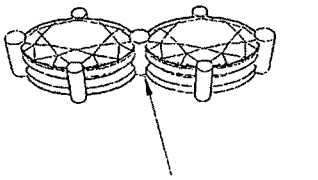

FIG.15

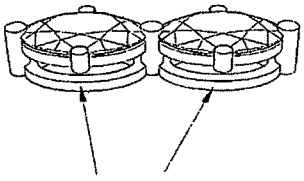

FIG.16

TWO STONE SAMPLES:

2 Stone Samples – Round Brilliant Cut

TOP VIEW:

FRONT VIEW (open shared prong):

RIGHT VIEW

PERSPECTIVE VIEWS:

Open shared prong, close side prongs

Closed shared prong, closed side prongs

Closed shared prong open side prongs

2 Stone Samples - Oval Shape –Vertical Layout –

TOP VIEW:

FRONT VIEW, (open shared prong):

RIGHT VIEW:

PERSPECTIVE VIEWS:

Open shared prong, close side prongs

Closed shared prong, closed side prongs

Closed shared prong open side prongs

2 Stone Samples - Oval Shape – Horizontal layout –

TOP VIEW:

FRONT VIEW (closed shared prong):

RIGHT VIEW:

PERSPECTIVE VIEWS:

Closed shared prong, closed side prongs

Open shared prong, close side prongs

Closed shared prong open side prongs

2 Stone Samples – Vertical Emerald-cut

TOP VIEW

FRONT VIEW (closed shared prong):

RIGHT VIEW

PERSPECTIVE VIEWS:

Closed shared prong, closed side prongs

Open shared prong, close side prongs

Closed shared prong open side prongs

2 Stone Samples – Horizontal Emerald-cut

TOP VIEW:

FRONT VIEW (open shared prong):

RIGHT VIEW:

PERSPECTIVE VIEW:

Open shared prong, close side prongs

Closed shared prong closed side prongs

Closed shared prong open side prongs

2 Stone Samples - Baguette Shape Horizontal layout

TOP VIEW:

FRONT VIEW (open shared prongs):

RIGHT VIEW:

PERSPECTIVE VIEWS:

Open shared prong, close side prongs

Closed shared prong closed side prongs

Closed shared prong open side prongs

2 Stone Samples - Baguette Shape – Vertical layout

TOP VIEW:

FRONT VIEW, closed shared prong:

RIGHT VIEW

PERSPECTIVE VIEWS:

Closed shared prong closed side prongs

Open shared prong, close side prongs

Closed shared prong open side prongs

2 Stone Samples – Asschers-Cut

TOP VIEW:

FRONT VIEW (Closed shared prong):

RIGHT VIEW:

PERSPECTIVE VIEWS:

Closed shared prong, closed side prongs

Open shared prong, close side prongs

Closed shared prong, open side prongs

2 Stone Samples ~ Cushion Shape

TOP VIEW:

FRONT VIEW (open shared prong):

RIGHT VIEW:

PROSPECTIVE VIEWS:

Open shared prong, closed side prongs

Closed shared prong, closed side prongs

Closed shared prong, open side prongs

2 Stone Samples –Radiant Cut

TOP VIEW:

FRONT VIEW (open shared prongs)

RIGHT VIEW

PERSPECTIVE VIEWS:

Open shared prong, closed side prongs

Closed shared prong, closed side prongs

Closed shared prong, open side prongs

2 Stone Samples – Princess-Cut / Square Shape

TOP VIEW:

FRONT VIEW, (closed shared prong):

RIGHT VIEW:

PROSPECTIVE VIEW:

Closed shared prong, closed side prongs

Open shared prong, closed side prongs

Closed shared prong, open side prongs

FIG.83
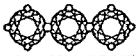
ROUND BRILLIANT-CUT
FIG.84
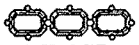
EMERALD-CUT
SET HORIZONTALLY
FIG.85
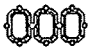
EMERALD-CUT
SET VERTICALLY
FIG.86
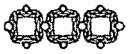
CUSCION-CUT
(SQUARE OR RECTANGULAR)
FIG.87
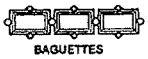
BAGUETTES
SET HORIZONTALLY
FIG.88
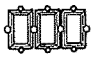
BAGUETTES
SET VERTICALLY
FIG.89
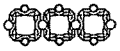
RADIANT-CUT
(SQUARE OR RECTANGULAR)
FIG.90
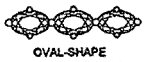
OVAL-SHAPE
SET HORIZONTALLY
FIG.91
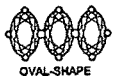
OVAL-SHAPE
SET VERTICALLY
FIG.92
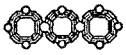
ASSCHER
FIG.93
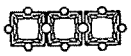
PRINCESS/SQUARE -CUT
Real Samples of "VBS":
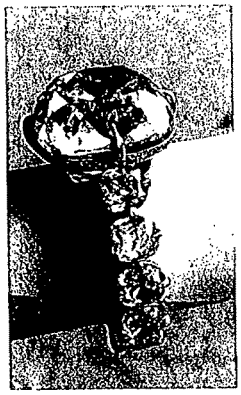
FIG.94
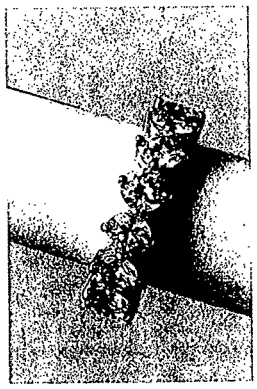
FIG.95
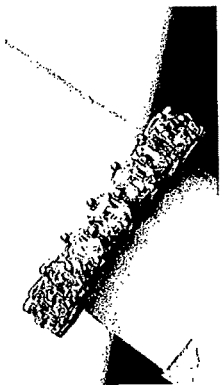
FIG.96

SAMPLE OF TENNIS/LINK BRACELET WITH ROUND BRILLIANT CUT GEMSTONES

SAMPLE OF TENNIS/LINK NECKLACE WITH SQUARE RADIANT CUT GEMSTONES

SAMPLE OF HOOP EARRINGS WITH ROUND BRILLIANT CUT GEMSTONES

THE SAME TAPERED LAY-OUT CONCEPT CAN BE DONE WITH DIFFERENT SHAPED-STONES.

SEE SAMPLE BELOW 3 STONES TAPERED LAYOUT:

SAMPLE OF RING WITH TAPERED EMERALD-CUT GEMSTONES SET VERTICALLY
Top View - FIG.101
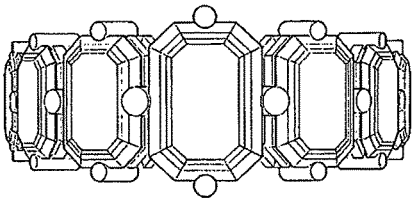
Side View - FIG.102
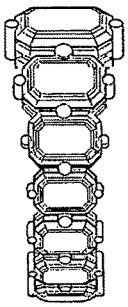
Prospective View – FIG.103
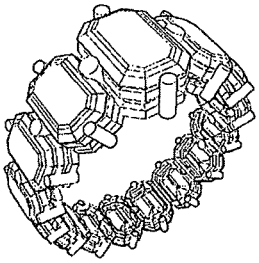

SAMPLE OF TENNIS BRACELET/LINK-BRACELET WITH TAPERED CUSHION SHAPE GEMSTONES

SAMPLE OF HOOP EARRINGS WITH TAPERED ROUND BRILLIANT CUT GEMSTONES

THE SAME TAPERED LAY-OUT CONCEPT CAN BE DONE WITH DIFFERENT SHAPED-STONES.

SAMPLE OF RING WITH MULTILAYERS - SQUARE-RADIANTS
TOP VIEW – FIG.108
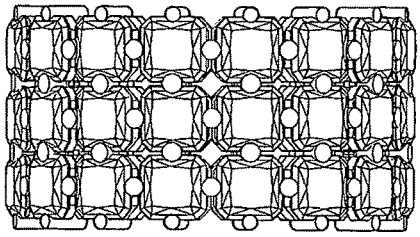
FRONT VIEW – FIG 109
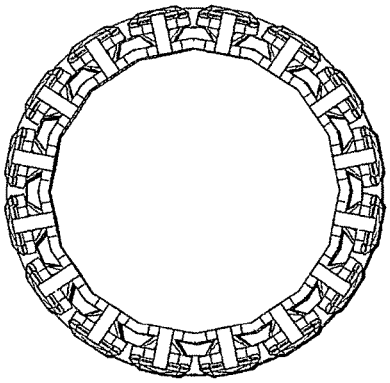

RIGHT VIEW – FIG.110
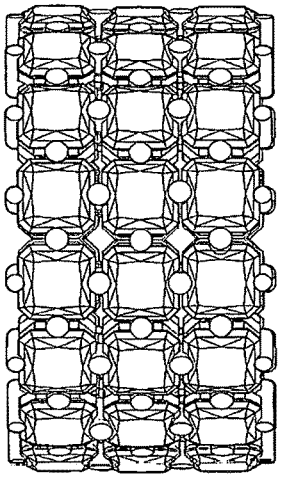
PROSPECTIVE VIEW – FIG.111
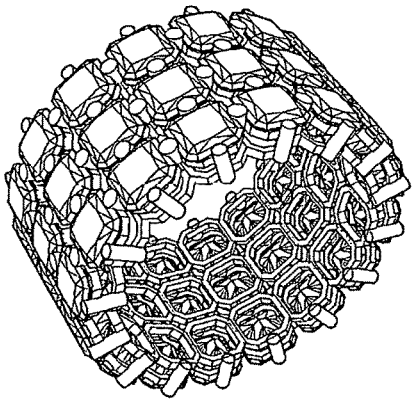

SAMPLE OF BRACELET/CHOCKER NECKLACE WITH MULTI-LAYERED CUSHION SHAPED GEM STONES

SAMPLE OF HOOP-EARRINGS WITH MULTI-LAYERES ROUND BRILLIANT-CUT GEMSTONES

THE SAME MULTILAYER LAY-OUT CONCEPT CAN BE DONE WITH DIFFERENT SHAPED-STONES.

SEE SAMPLE BELOW:

SAMPLES OF 3-STONE RING WITH EMERALD CUT, PRINCESS CUT AND ROUND BRILLIANT CUT GEMSTONES

TOP VIEW:

SIDE VIEW:

PERSPECTIVE VIEW:

THE SAME 3-STONE LAY-OUT CONCEPT CAN BE DONE WITH DIFFERENT SHAPED-STONES.

SEE SAMPLE BELOW:

SAMPLE OF ENGAGEMENT RING WITH CUSHION-CUT GEMSTONES

SAMPLE OF WEDDING BAND WITH CUSCION CUT GEMSTONES

SAMPLE OF ENGAGEMENT RING WITH ROUND BRILLIANT CUT GEMSTONES

SAMPLE OF WEDDING BAND WIRH ROUND BRILLIANT CUT GEMSTONES

SAMPLE OF ENGAGEMENT RING WIH ASSCHER CUT GEMSTONES

SAMPLE OF WEDDING BAND WITH ASSCHER CUT GEMSTONES

SAMPLE OF ENGAGEMENT RING WITH OVAL SHAPE GEMSTONES

SAMPLE OF WEDDING BAND WITH OVAL SHAPE GEMSTONES

CROSSES/PENDANTS
CROSSES WITH DIFFERENT COMBINATION OF STONES

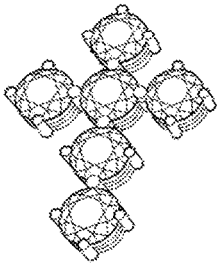

FIG. 127

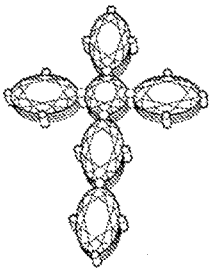

FIG. 128

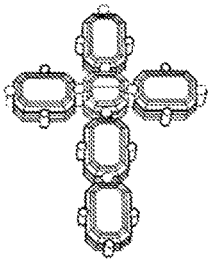

FIG. 129

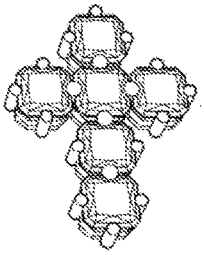

FIG. 130

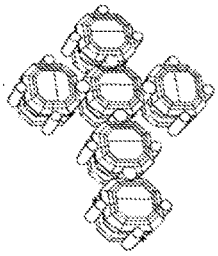

FIG. 131

THE EMERALD CUT & ASSCHER CROSS CAN BE ALSO MADE WITH RECTANGULAR AND SQUARE RADIANT-CUT STONES.

THE CROSS CAN ALSO BE MADE IN ALL CUSHIONS, IN ALL PRINCESS/SQUARE-CUT AND IN BAGUETTES & SQUARE-CUT.

MULTI-SHAPES COMBINED TOGETHER
As described below, with the "VBS" stone-setting system all different shapes in different sizes can be combined together; therefore, the combinations are endless!

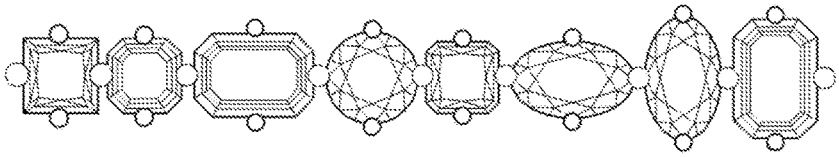

THIS SAMPLE SHOWS HOW ALL SHAPES CAN BE COMBINED TOGETHER TO CREATE JEWELRY. THE COMBINATIONS ARE ENDLESS

FIG. 132

HERE ARE SOME EXAMPLE OF HOW THE ENDLESS COMBINATIONS ALLOWS TO CREATE AMAZING JEWELRY:

Clip earrings or pendant:

Dangling Earrings:

RINGS, BRACELETS, NECKLACES & HOOP EARRINGS CAN BE MADE WITH TWO OR MORE STONES OF ANY SHAPE, SIZE OR MATERIAL

STONES CAN BE THE SAME SIZE AS ILLUSTRATED ABOVE OR GRADUATED

JEWELRY SETTING SYSTEM

FIELD OF THE INVENTION

The present invention relates to a unique setting system using shared prongs and side prongs, wherein the shared prongs are placed between adjacent stones, at the mid-point of the adjacent stones. Also, side prongs are placed at the mid-point of each side stone. In this manner, the view of each stone is not blocked, so that the maximum surface and shape of each stone is visible to the wearer or the viewer.

BACKGROUND OF THE INVENTION

Existing jewelry settings block or hide from view the beauty and shape of the stones, so that they are not fully appreciated by the user or the viewer. An improved system is desirable to overcome this problem, which is provided by the invention as explained herein.

DESCRIPTION OF THE PRIOR ART

U.S. Pat. No. 6,389,846 discloses different types of prongs in different types of settings, which are different from the present invention.

U.S. patent application no. 2003/56536 discloses different types of prongs in different types of settings, which are different from the present invention.

U.S. Pat. No. 2,200,841 discloses different types of prongs in different types of settings, which are different from the present invention.

U.S. patent application no. 2005/0188722 discloses different types of prongs in different types of settings, which are different from the present invention.

U.S. Pat. No. 9,351,546 discloses different types of prongs in different types of settings, which are different from the present invention.

U.S. Pat. No. 232,653 discloses different types of prongs in different types of settings, which are different from the present invention.

U.S. Pat. No. 1,204,916 discloses different types of prongs in different types of settings, which are different from the present invention.

OBJECTS OF THE INVENTION

It is an object of the invention to provide an improved and innovative jewelry stone setting system.

It is another object of the invention to provide a shared prong between adjacent stones at their mid-point, so that adjacent stones are much more visible to the wearer and the viewer.

It is a further object of the invention to provide a side prong at the mid-point of the side of each stone, so that adjacent stones are much more visible to the wearer and the user.

It is a further object of the invention to provide a setting, which can be used with any type of stone. Any type of stones can be mounted, such as precious stones, semi-precious stones, synthetic stones, and any shape of stone can also be mounted such as: cushion stones, asscher stones, round brilliant stones, oval stones, emerald cut stones, baguette shaped stones, radiant cut stones, princess cut stones, or any fancy shape.

It is a further object of the invention to provide a setting which can be used with any size stone in the range of 0.03 carats to 50.0 carats, any shape of stone, and made of any material.

SUMMARY OF THE INVENTION

The present invention provides an improved jewelry stone setting system, having a plurality of stones each having a shared side connected to an adjacent stone to form a setting, and wherein each stone has outer exposed sides connected to form a setting. A single shared prong is placed between adjacent stones at the mid-point of two adjacent girdles to form the setting. A single side prong is placed on each of the exposed sides of each stone at the mid-point of the girdle of the side stone to form the setting. Each of the shared prongs are either open or closed to increase visibility of the stone to the wearer or user. Each of the shared prongs extend from the upper basket to the girdle of the stone to form an open shared prong. Each of the shared prongs extend from the bottom basket to the girdle of the stone to form a closed shared prong. Each of the side prongs are also open or closed to increase visibility of the stones.

BRIEF DESCRIPTION OF THE DRAWINGS

Prior Art

VBS New Stone Setting System

Figure 12:
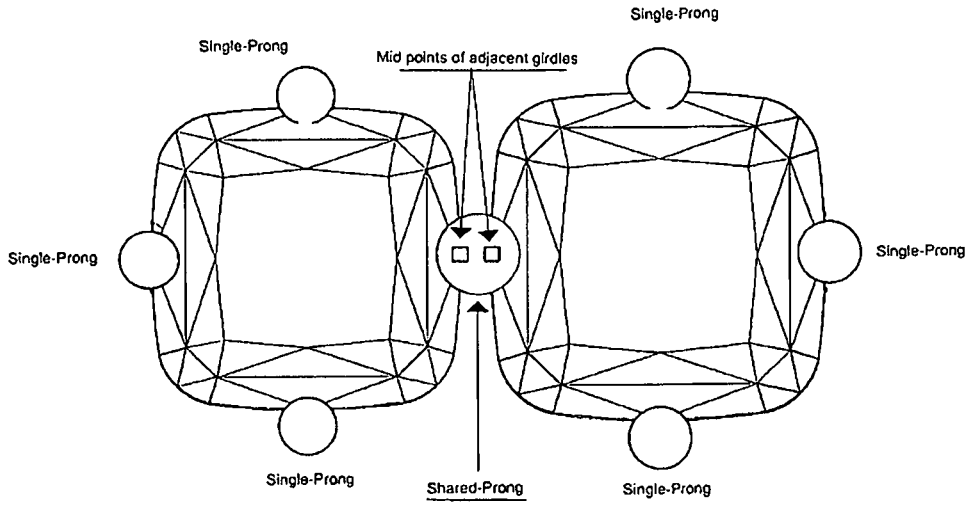
Figure 17:
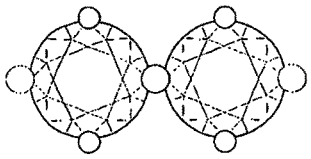
Figure 18:
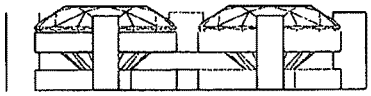
Figure 19:
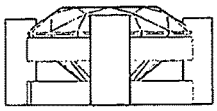
Figure 20:
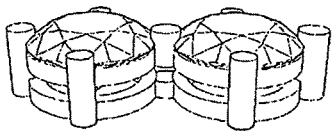
Figure 21:
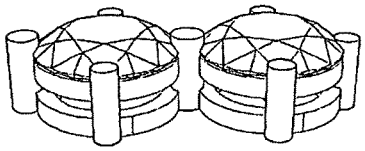
Figure 22:
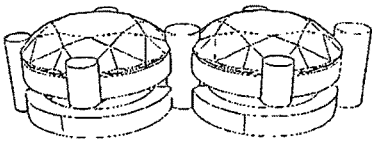
Figure 23:
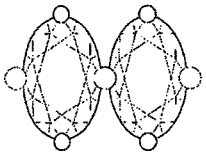
Figure 24:
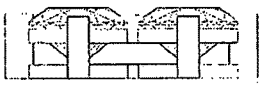
Figure 25:
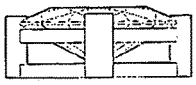
Figure 26:
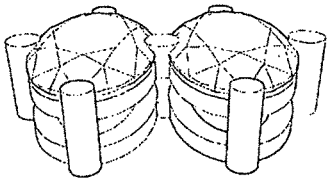
Figure 27:
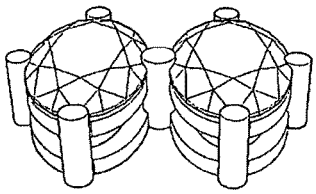
Figure 28:
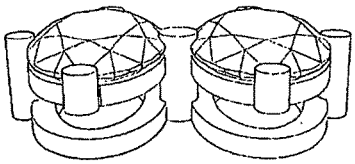
Figure 29:
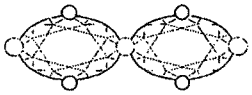
Figure 30:
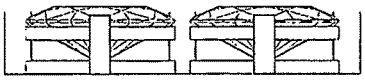
Figure 31:
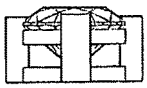
Figure 32:
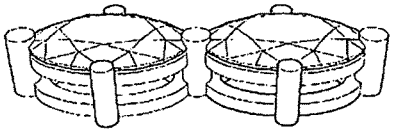
Figure 33:
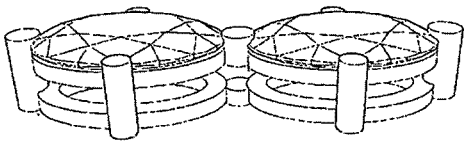
Figure 34:
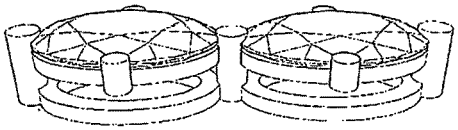
Figure 35:
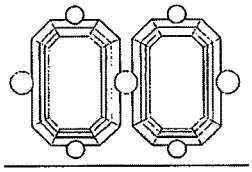
Figure 36:
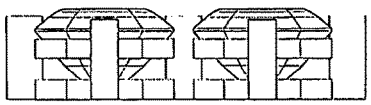
Figure 37:
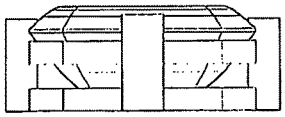
Figure 38:
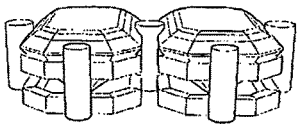
Figure 39:
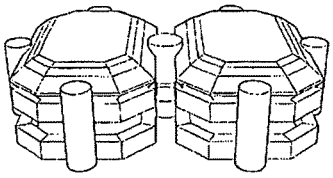
Figure 40:
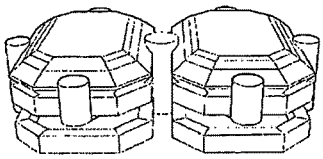
Figure 41:
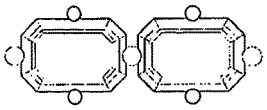
Figure 42:
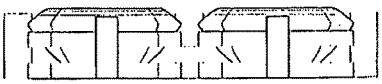
Figure 43:
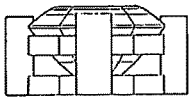
Figure 44:
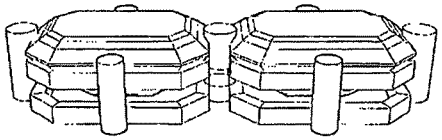
Figure 45:
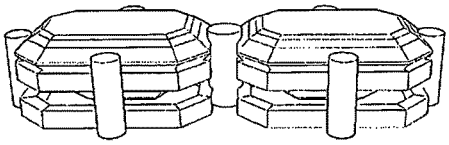
Figure 46:
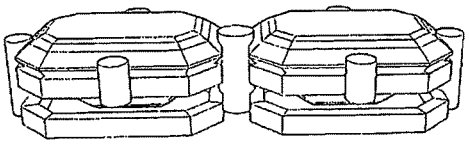
Figure 47:
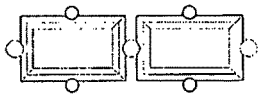
Figure 48:
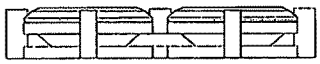
Figure 49:
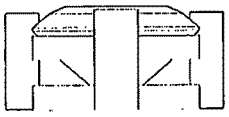
Figure 50:
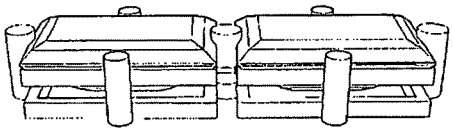
Figure 51:
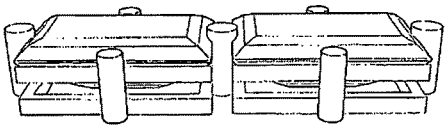
Figure 52:
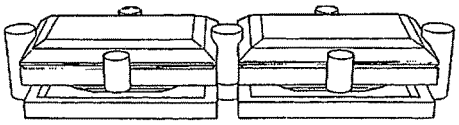
Figure 53:
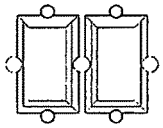
Figure 54:
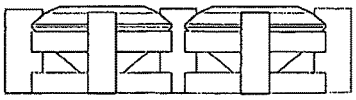
Figure 55:
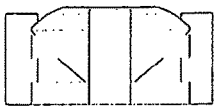
Figure 56:
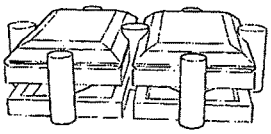
Figure 57:
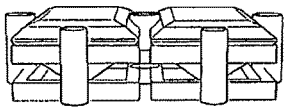
Figure 58:
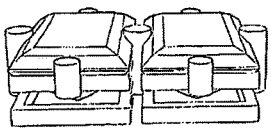
Figure 59:
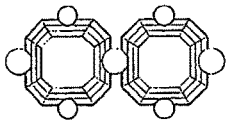
Figure 60:
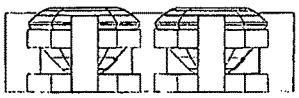
Figure 61:
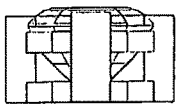
Figure 62:
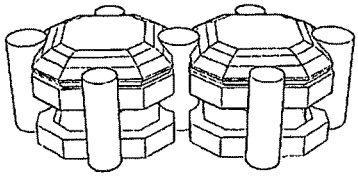
Figure 63:
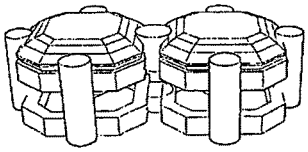
Figure 64:
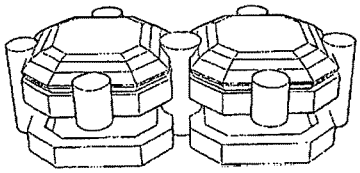
Figure 65:
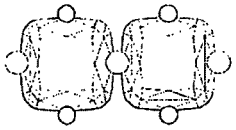
Figure 66:
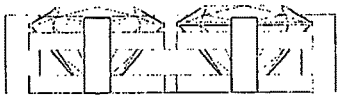
Figure 67:
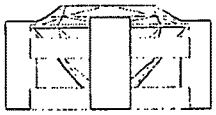
Figure 68:
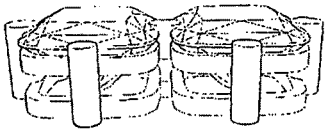
Figure 69:
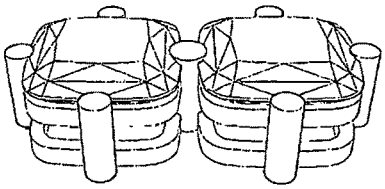
Figure 70:
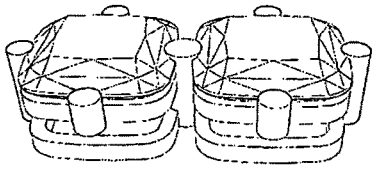
Figure 71:
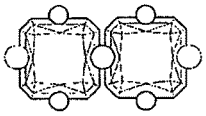
Figure 72:
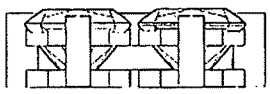
Figure 73:
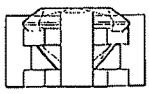
Figure 74:
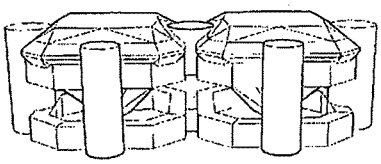
Figure 75:
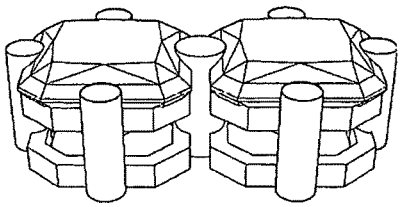
Figure 76:
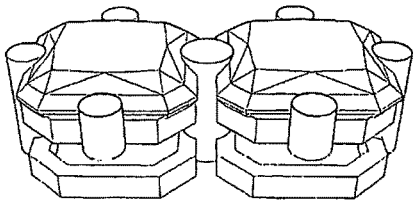
Figure 77:
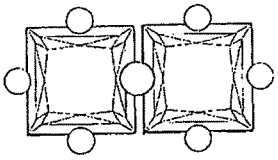
Figure 78:
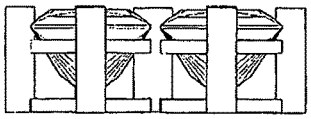
Figure 79:
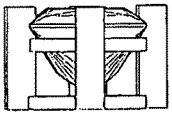
Figure 80:
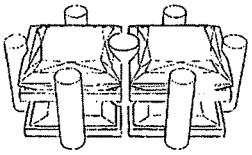
Figure 81:
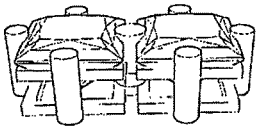
Figure 82:
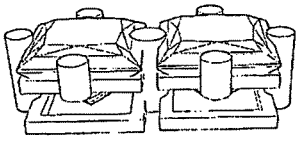
Figure 97:
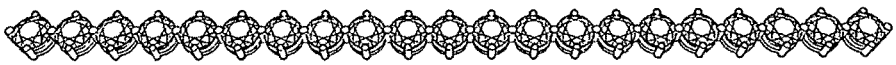
Figure 98:
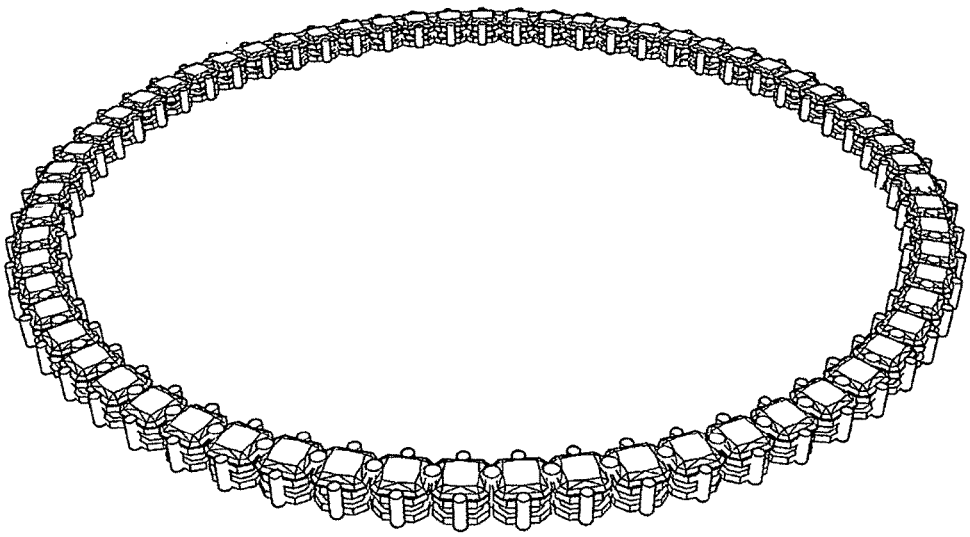
Figure 99:
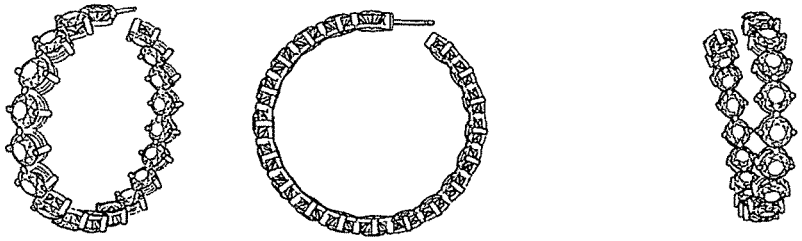
Figure 100:
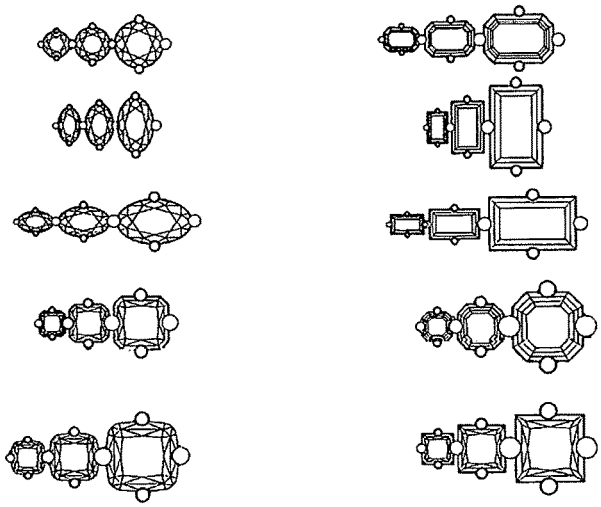
Figure 104:
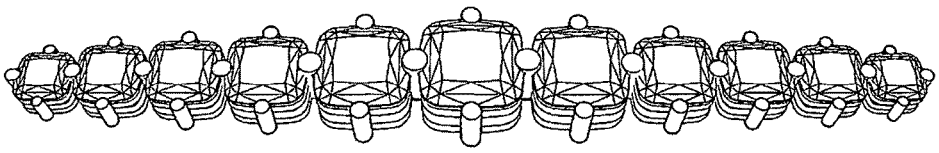
Figure 105:
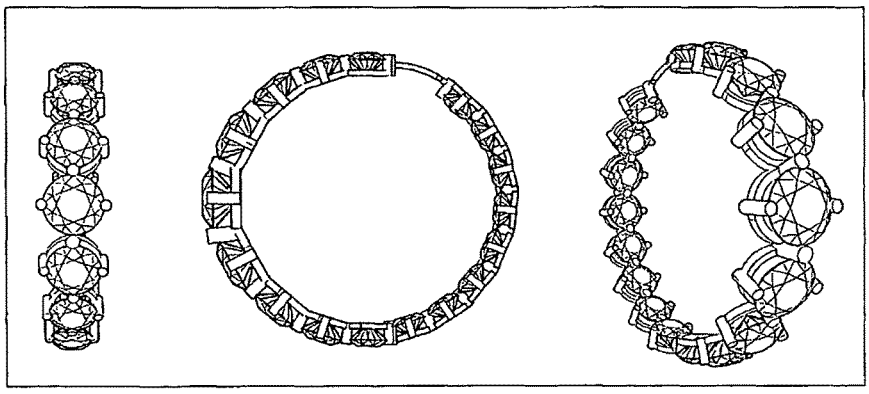
Figure 106:
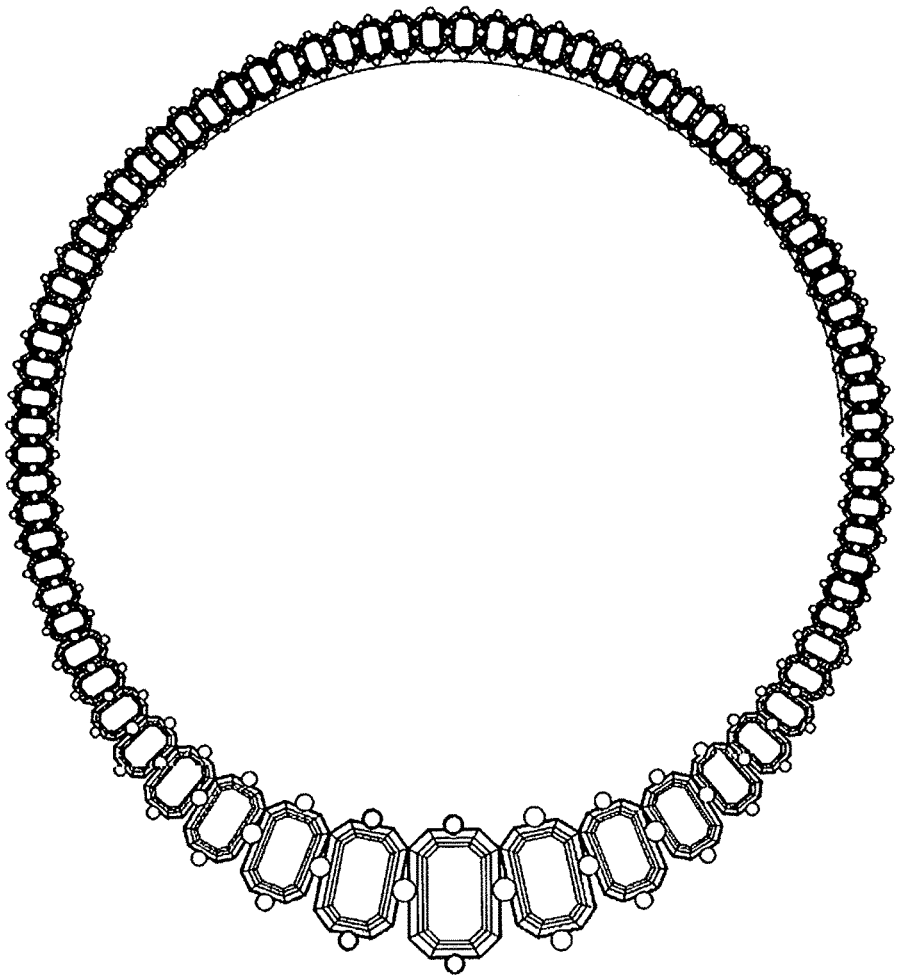
Figure 107:
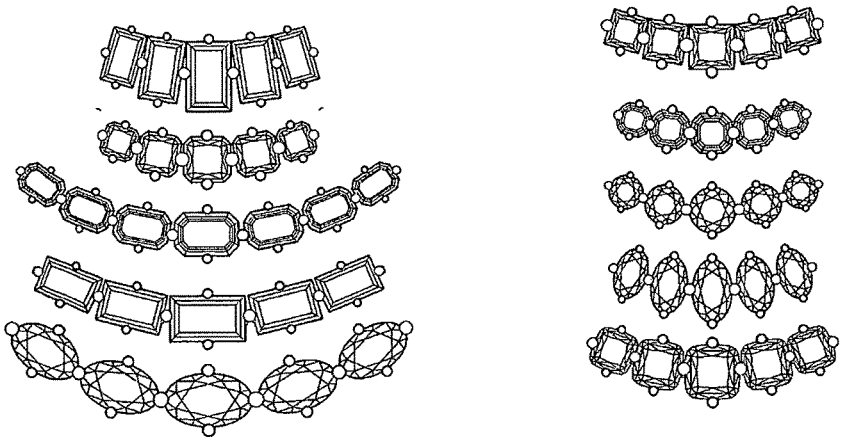
Figure 112:
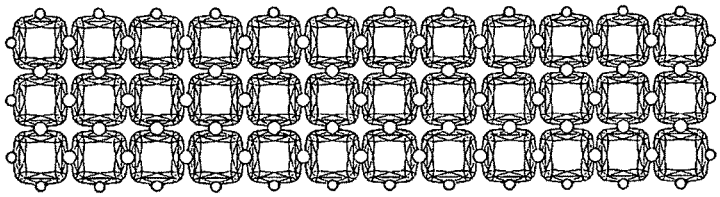
Figure 113:
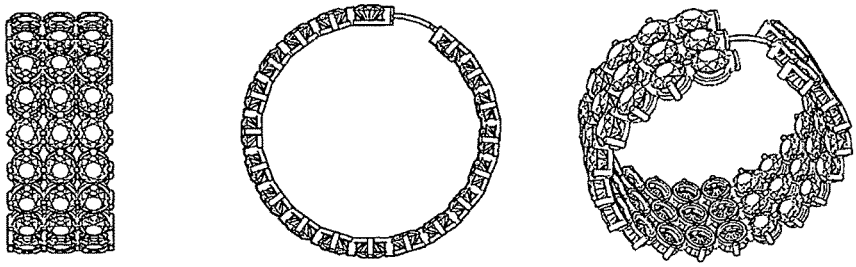
Figure 114:
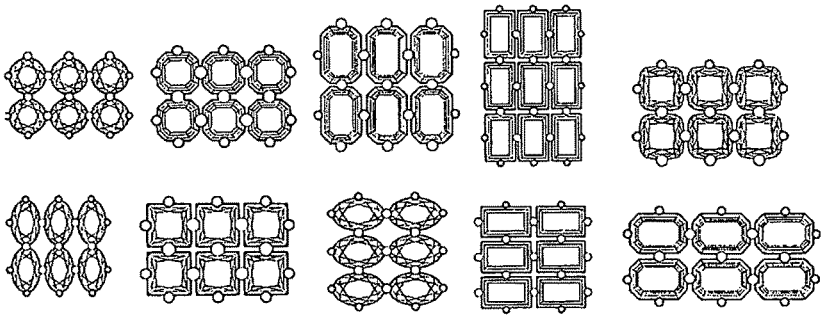
Figure 115:
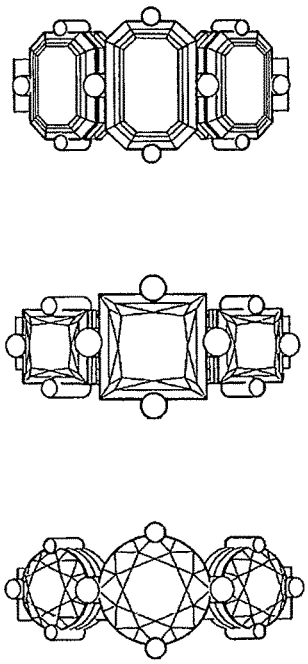
Figure 116:
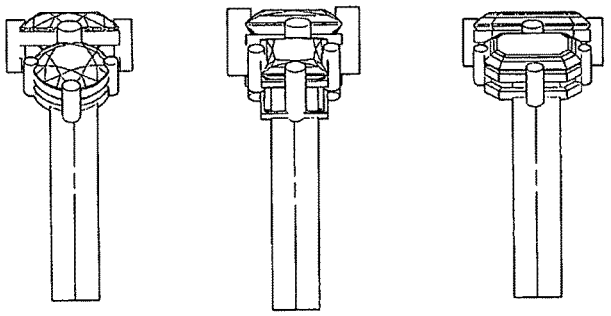
Figure 117:
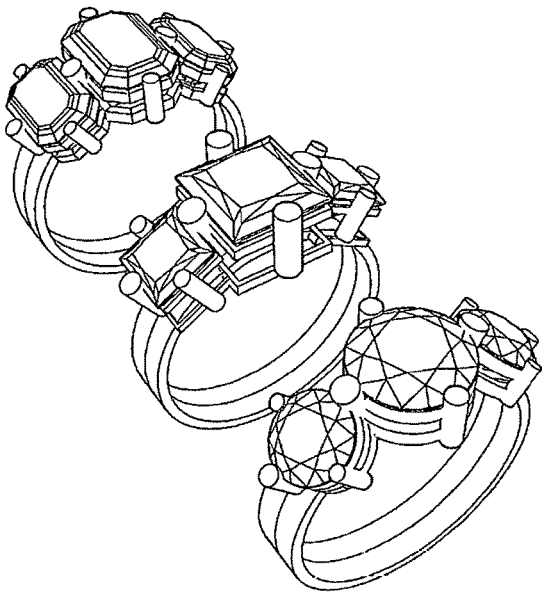
Figure 118:
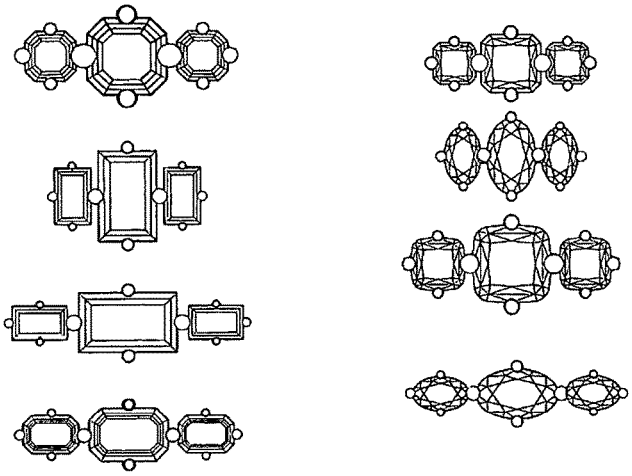
Figure 119:
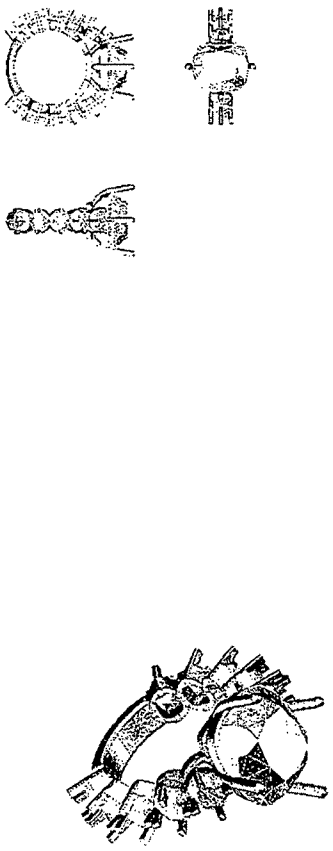
Figure 120:
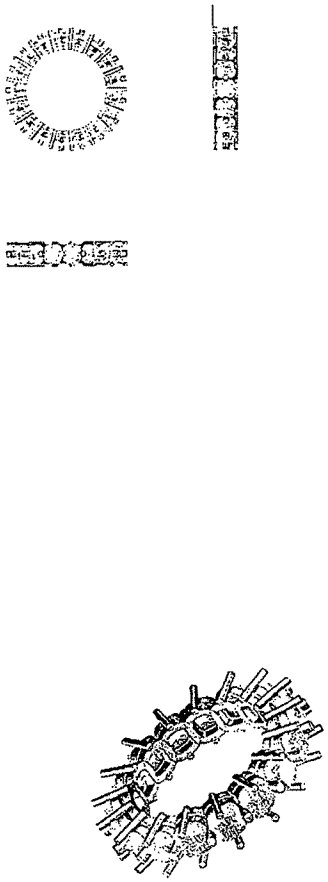
Figure 121:
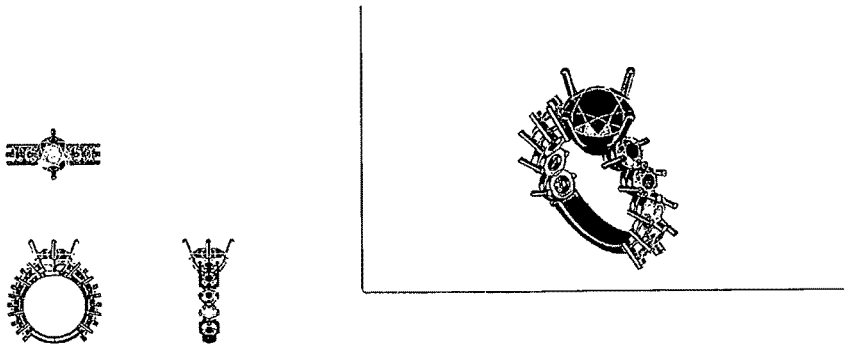
Figure 122:
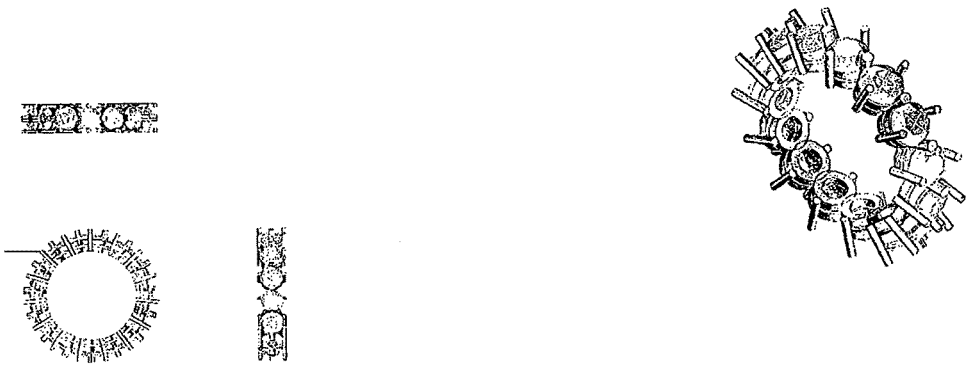
Figure 123:
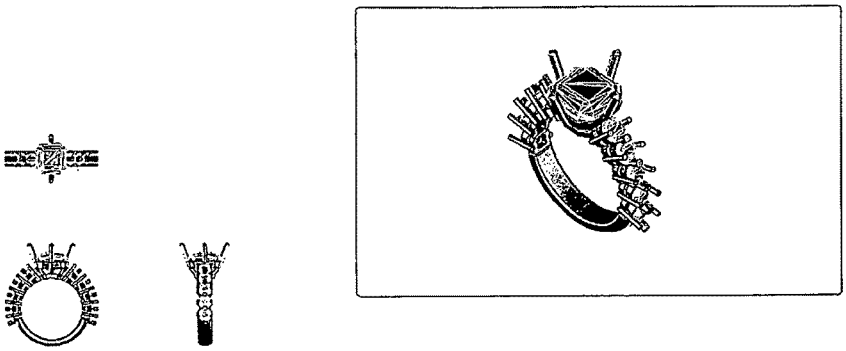
Figure 124:
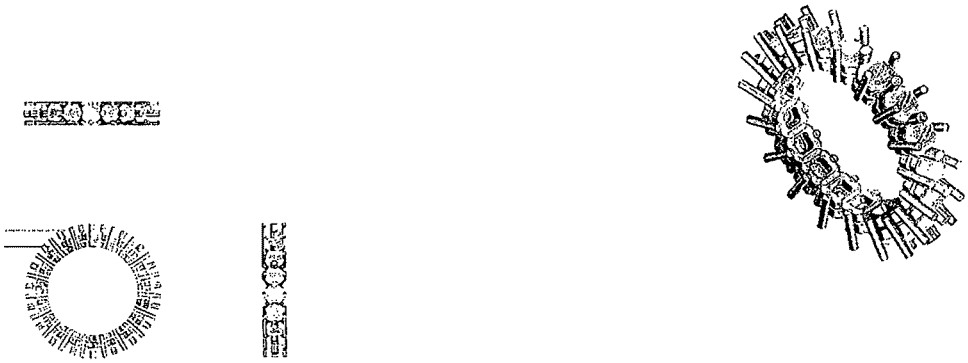
Figure 125:
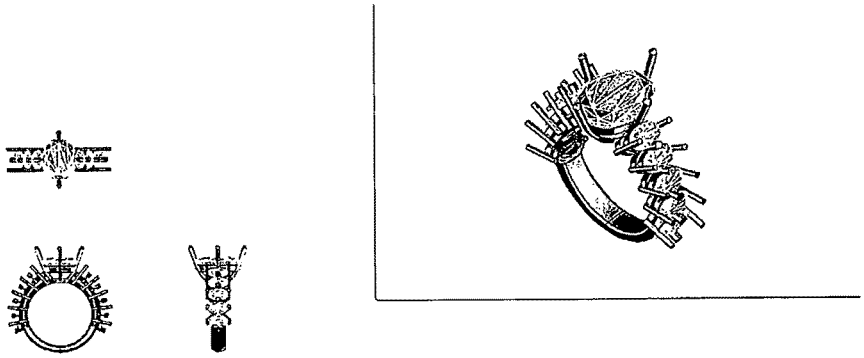
Figure 126:
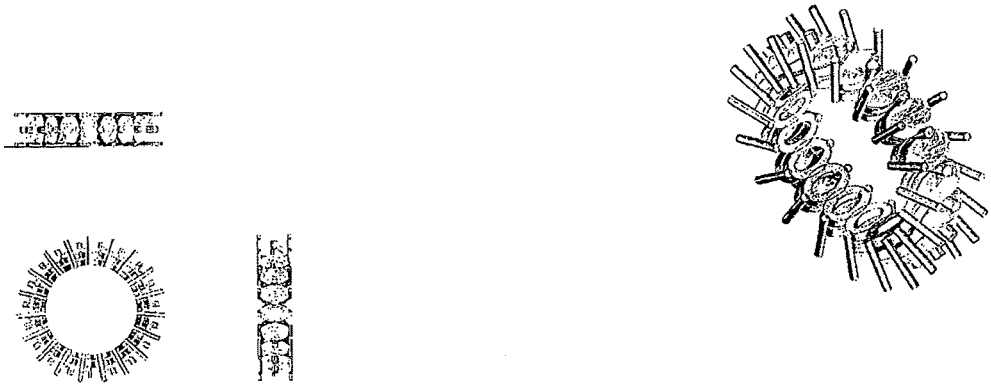
Figure 133:
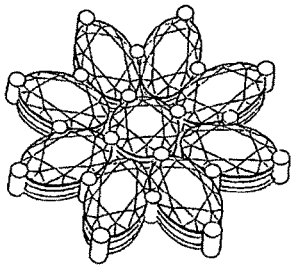
Figure 134:
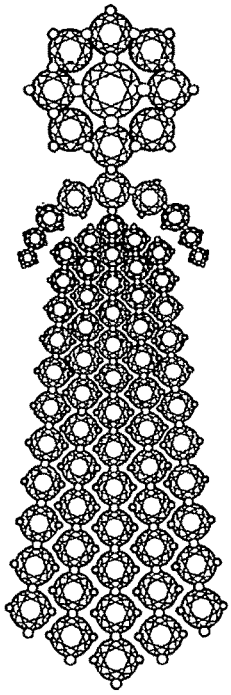
Figure 135:
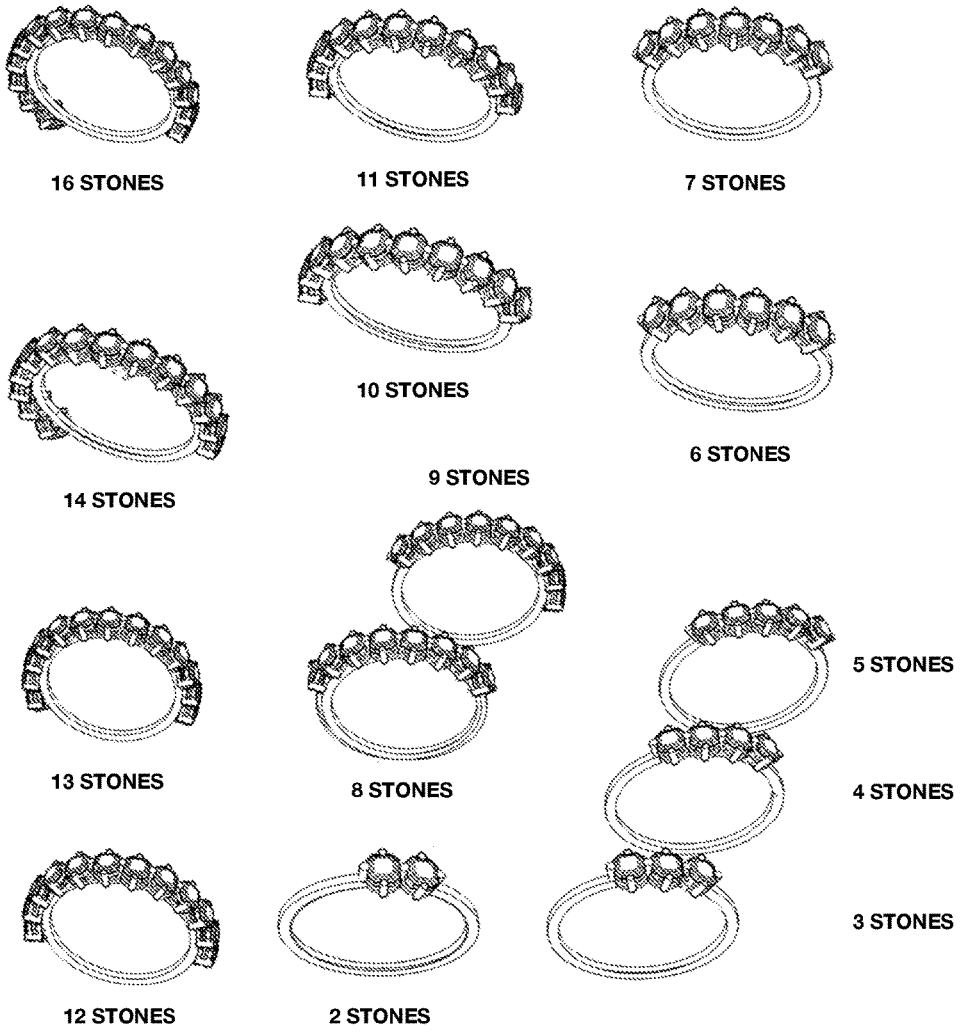

FIG. 12 is a top view of the new stone setting system showing two or more stones having one shared prong shared between two stones, wherein the shared prong is placed in the mid-point of the two adjacent girdles, and wherein one single prong is placed on each of the three remaining mid-points of the girdle; so that each prong is placed at the north, south, east, and west of each stone, as shown;

FIG. 13 shows a multi-layer stone setting, wherein the shared prong is placed in the mid-point of the adjacent girdles of each stone, and wherein the single prongs are located on the external mid-point of the girdle of each stone;

FIG. 14 is a perspective view of two stones showing an open shared prong, wherein the shared prong rises from the upper basket to the girdle to form the open shared prong;

FIG. 15 shows a perspective view of the two stones showing a closed shared prong, wherein the shared prong rises from the bottom basket to the girdle to form a closed shared prong;

FIG. 16 shows a perspective view of the two stones having open side prongs, wherein the shared prong is closed and the side prongs are open;

FIG. 17 is a top view of two round brilliant cut stones and an open shared prong between the two stones;

FIG. 18 is a front perspective view of the open shared prong, and closed side prongs set with round brilliant;

FIG. 19 is a right side view of the opened shared prong, and the closed side prongs set with round brilliant;

FIG. 20 is a perspective view of the two round brilliant cut stones shown in FIG. 17, having an opened shared prong between the two stones, and closed side prongs on the remaining three sides of each stone;

FIG. 21 is a perspective view of the two round brilliant cut stones, having a closed shared prong between the two stones, and closed side prongs on the remaining three sides of each stone;

FIG. 22 is a perspective view of the two round brilliant cut stones, having a closed shared prong between the two stones, and open side prongs on two sides of each stone;

FIG. 23 is a top view of two oval shaped stones having a vertical layout, having an open shared prong between the two stones, and closed side prongs on the remaining three sides of each stone;

FIG. 24 is a front view of two oval shaped stones having a vertical layout, having an open shared prong between the two stones, and closed side prongs on the remaining three sides of each stone;

FIG. 25 is a side view of two oval shaped stones having a vertical layout, having an open shared prong between the two stones, and closed side prongs on the remaining three sides of each stone;

FIG. 26 is a perspective view of two oval shaped stones set vertically or having a vertical layout, having an open shared prong between the two stones, and closed side prongs on the remaining three sides of each stone;

FIG. 27 is a perspective view of two oval shaped stones set vertically or having a vertical layout, having a closed shared prong between the two stones, and closed side prongs on the remaining three sides of each stone;

FIG. 28 is a perspective view of the two oval shaped stones set vertically or having a vertical layout, having a closed shared prong between the two stones, and open side prongs on two of the remaining sides of each stone;

FIG. 29 is a top view of the two oval shaped stones, having a horizontal layout, and having a closed shared prong between the two stones, and closed side prongs on the remaining three sides of each stone;

FIG. 30 is a front view of the two oval shaped stones, having a horizontal layout, and having a closed shared prong between the two stones, and closed side prongs on the remaining three sides of each stone;

FIG. 31 is a side view of the two oval shaped stones, having a horizontal layout, and having a closed shared prong between the two stones, and closed side prongs on the remaining three sides of each stone;

FIG. 32 is a perspective view of the two oval shaped stones, having a horizontal layout, and having a closed shared prong between the two stones, and closed side prongs on the remaining three sides of each stone;

FIG. 33 is a perspective view of the two oval shaped stones, having a horizontal layout, and having an open shared prong between the two stones, and closed side prongs on the remaining three sides of each stone;

FIG. 34 is a perspective view of the two oval shaped stones, having a horizontal layout, and having a closed shared prong between the two stones, and open side prongs on two of the remaining sides of each stone;

FIG. 35 is a top view of the two emerald cut stones having a vertical layout, and having a closed shared prong between the two stones, and closed side prongs on the remaining three sides of each stone;

FIG. 36 is a front view of the two emerald cut stones having a vertical layout, and having a closed shared prong between the two stones, and closed side prongs on the remaining three sides of each stone;

FIG. 37 is a side view of the two emerald cut stones having a vertical layout, and having a closed shared prong between the two stones, and closed side prongs on the remaining three sides of each stone;

FIG. 38 is a perspective view of the two emerald cut stones having a vertical layout, and having a closed shared prong between the two stones, and closed side prongs on the remaining three sides of each stone;

FIG. 39 is a perspective view of the two emerald cut stones having a vertical layout, and having an open shared prong between the two stones, and closed side prongs on the remaining three sides of each stone;

FIG. 40 is a perspective view of the two emerald cut stones having a vertical layout, and having a closed shared prong between the two stones, and opened side prongs on two of the remaining sides of each stone;

FIG. 41 is a top view of the two emerald cut stones having a horizontal layout, and having an open shared prong between the two stones, and closed side prongs on the remaining three sides of each stone;

FIG. 42 is a front view of the two emerald cut stones having a horizontal layout, and having an open shared prong between the two stones, and closed side prongs on the remaining three sides of each stone;

FIG. 43 is a side view of the two emerald cut stones having a horizontal layout, and having an open shared prong between the two stones, and closed side prongs on the remaining three sides of each stone;

FIG. 44 is a perspective view of the two emerald cut stones having a horizontal layout, and having an open shared prong between the two stones, and closed side prongs on the remaining three sides of each stone;

FIG. 45 is a perspective view of the two emerald cut stones having a horizontal layout, and having a closed shared prong between the two stones, and closed side prongs on the remaining three sides of each stone;

FIG. 46 is a perspective view of the two emerald cut stones having a horizontal layout, and having a closed shared prong between the two stones, and open side prongs on two of the remaining sides of each stone;

FIG. 47 is a top view of the two baguette shaped stones having a horizontal layout, and having an open shared prong between the two stones, and closed side prongs on the remaining three sides of each stone;

FIG. 48 is a front view of the two baguette shaped stones having a horizontal layout, and having an open shared prong between the two stones, and closed side prongs on the remaining three sides of each stone;

FIG. 49 is a side view of the two baguette shaped stones having a horizontal layout, and having an open shared prong between the two stones, and closed side prongs on the remaining three sides of each stone;

FIG. 50 is a perspective view of the two baguette shaped stones having a horizontal layout, and having an open shared prong between the two stones, and closed side prongs on the remaining three sides of each stone;

FIG. 51 is a perspective view of the two baguette shaped stones having a horizontal layout, and having a closed shared prong between the two stones, and open side prongs on the remaining three sides of each stone;

FIG. 52 is a perspective view of the two baguette shaped stones having a horizontal layout, and having a closed shared prong between the two stones, and open side prongs on two of the remaining sides of each stone;

FIG. 53 is a top view of the two baguette shaped stones having a vertical layout, and having a closed shared prong between the two stones, and closed side prongs on the remaining three sides of each stone;

FIG. 54 is a front view of the two baguette shaped stones having a vertical layout, and having a closed shared prong between the two stones, and closed side prongs on the remaining three sides of each stone;

FIG. 55 is a side view of the two baguette shaped stones having a vertical layout, and having a closed shared prong between the two stones, and closed side prongs on the remaining three sides of each stone;

FIG. 56 is a perspective view of the two baguette shaped stones having a vertical layout, and having a closed shared prong between the two stones, and closed side prongs on the remaining three sides of each stone;

FIG. 57 is a perspective view of the two baguette shaped stones having a vertical layout, and having an open shared prong between the two stones, and closed side prongs on the remaining three sides of each stone;

FIG. 58 is a perspective view of the two baguette shaped stones having a vertical layout, and having a closed shared prong between the two stones, and open side prongs on two of the remaining sides of each stone;

FIG. 59 is a top view of the two asscher-cut stones having a closed shared prong between the two stones, and closed side prongs on the remaining three sides of each stone;

FIG. 60 is a front view of the two asscher-cut stones having a closed shared prong between the two stones, and closed side prongs on the remaining three sides of each stone;

FIG. 61 is a right side view of the two asscher-cut stones having a closed shared prong between the two stones, and closed side prongs on the remaining three sides of each stone;

FIG. 62 is a perspective view of the two asscher-cut stones having a closed shared prong between the two stones, and closed side prongs on the remaining three sides of each stone;

FIG. 63 is a perspective view of the two asscher-cut stones having an open shared prong between the two stones, and closed side prongs on the remaining three sides of each stone;

FIG. 64 is a perspective view of the two asscher-cut stones having a closed shared prong between the two stones, and open side prongs on two of the remaining sides of each stone;

FIG. 65 is a top view of the two cushion shaped stones having an open shared prong between the two stones, and closed side prongs on the remaining three sides of each stone;

FIG. 66 is a front view of the two cushion shaped stones having an open shared prong between the two stones, and closed side prongs on the remaining three sides of each stone;

FIG. 67 is a side view of the two cushion shaped stones having an open shared prong between the two stones, and closed side prongs on the remaining three sides of each stone;

FIG. 68 is a perspective view of the two cushion shaped stones having an open shared prong between the two stones, and closed side prongs on the remaining three sides of each stone;

FIG. 69 is a perspective view of the two cushion shaped stones having a closed shared prong between the two stones, and closed side prongs on the remaining three sides of each stone;

FIG. 70 is a perspective view of the two cushion shaped stones having a closed shared prong between the two stones, and open side prongs on two of the remaining sides of each stone;

FIG. 71 is a top view of the two radiant cut stones having an open shared prong between the two stones, and closed side prongs on the remaining three sides of each stone;

FIG. 72 is a front view of the two radiant cut stones having an open shared prong between the two stones, and closed side prongs on the remaining three sides of each stone;

FIG. 73 is a side view of the two radiant cut stones having an open shared prong between the two stones, and closed side prongs on the remaining three sides of each stone;

FIG. 74 is a perspective view of the two radiant cut stones having an open shared prong between the two stones, and closed side prongs on the remaining three sides of each stone;

FIG. 75 is a perspective view of the two radiant cut stones having a closed shared prong between the two stones, and closed side prongs on the remaining three sides of each stone;

FIG. 76 is a perspective view of the two radiant cut stones having a closed shared prong between the two stones, and open side prongs on two of the remaining sides of each stone;

FIG. 77 is a top view of two princess cut/square shape stones having a closed shared prong between the two stones, and closed side prongs on the remaining three sides of each stone;

FIG. 78 is a front view of two princess cut/square shape stones having a closed shared prong between the two stones, and closed side prongs on the remaining three sides of each stone;

FIG. 79 is a side view of two princess cut/square shape stones having a closed shared prong between the two stones, and closed side prongs on the remaining three sides of each stone;

FIG. 80 is a perspective view of two princess cut/square shape stones having a closed shared prong between the two stones, and closed side prongs on the remaining three sides of each stone;

FIG. 81 is a perspective view of two princess cut/square shape stones having an open shared prong between the two stones, and closed side prongs on the remaining three sides of each stone;

FIG. 82 is a perspective view of two princess cut/square shape stones having a closed shared prong between the two stones, and open side prongs on two of the remaining sides of each stone;

FIG. 83 is a top view of the new stone setting system for rings, bands, bracelets, necklaces, and earrings with 3 or more stones having round brilliant cut stones have open or closed shared prongs between the stones, and side prongs that are open or closed;

FIG. 84 is a top view of the new stone setting system for rings, bands, bracelets, necklaces, and earrings with 3 or more stones having emerald cut stones having a horizontal layout, and having open or closed shared prongs between the stones, and side prongs that are open or closed;

FIG. 85 is a top view of the new stone setting system for rings, bands, bracelets, necklaces, and earrings with 3 or more stones having emerald cut stones having a vertical layout, and having open or closed shared prongs between the stones, and side prongs that are open or closed;

FIG. 86 is a top view of the new stone setting system for rings, bands, bracelets, necklaces, and earrings with 3 or more stones having cushion cut stones have open or closed shared prongs between the stones, and side prongs that are open or closed;

FIG. 87 is a top view of the new stone setting system for rings, bands, bracelets, necklaces, and earrings with 3 or more stones having baguette stones having a horizontal layout, and having open or closed shared prongs between the stones, and side prongs that are open or closed;

FIG. 88 is a top view of the new stone setting system for rings, bands, bracelets, necklaces, and earrings with 3 or more stones having baguette stones set with a vertical layout, and having open or closed shared prongs between the stones, and side prongs that are open or closed;

FIG. 89 is a top view of the new stone setting system for rings, bands, bracelets, necklaces, and earrings with 3 or more stones having radiant cut stones have open or closed shared prongs between the stones, and side prongs that are open or closed;

FIG. 90 is a top view of the new stone setting system for rings, bands, bracelets, necklaces, and earrings with 3 or more stones having oval shape stones set with a horizontal layout, and having open or closed shared prongs between the stones, and side prongs that are open or closed;

FIG. 91 is a top view of the new stone setting system for rings, bands, bracelets, necklaces, and earrings with 3 or more stones having oval shape stones set with a vertical layout, and having open or closed shared prongs between the stones, and side prongs that are open or closed;

FIG. 92 is a top view of the new stone setting system for rings, bands, bracelets, necklaces, and earrings with 3 or more stones having asscher-cut stones have open or closed shared prongs between the stones, and side prongs that are open or closed;

FIG. 93 is a top view of the new stone setting system for rings, bands, bracelets, necklaces, and earrings with 3 or more stones having princess square cut stones have open or closed shared prongs between the stones, and side prongs that are open or closed;

FIGS. 94, 95, and 96 show photos of actual samples of rings using the new VBS setting on rings having shared prongs that are open or closed between the stones, and side prongs on the stones that are open or closed;

FIG. 97 shows a tennis bracelet having round brilliant stones with shared prongs that can be open or closed, and side prongs that are open or closed;

FIG. 98 shows a tennis necklace having square radiant stones, with shared prongs that can be open or closed, and side prongs that are open or closed;

FIG. 99 shows hoop earrings having round brilliant stones, with shared prongs that can be open or closed, and side prongs that are open or closed;

FIG. 100 shows groups of multiple stones of different sizes connected to form settings for any type of jewelry using different shaped stones having shared and side prongs that are open or closed. The "VBS" stone setting system of the present invention can combine all different shaped stones and all different size stones, for such settings;

FIGS. 101, 102, and 103 show a ring having graduated emerald cut stones in a top view, side view, and a perspective view having shared prongs that can be open or closed, and side prongs that are open or closed;

FIG. 104 shows a tennis bracelet having graduated cushion stones having shared prongs that can be open or closed, and side prongs that are open or closed;

FIG. 105 shows hoop earrings having graduated round brilliant stones having shared prongs that can be open or closed, and side prongs that are open or closed;

FIG. 106 shows a necklace having different size stones connected to form a VBS setting having shared and side prongs that are open or closed;

FIG. 107 shows groups of five stones of different shapes connected to form a VBS setting, and also shows different types of stones to form the settings, having shared and side openings that are open or closed. Graduating stones of any size or shape may be used to create these necklaces;

FIGS. 108, 109, 110, and 111 show a top view, a front view, a side view and a perspective view of a ring (which can also be a necklace, or a hoop earring, or a bracelet), with square radiant stones connected to form a new VBS setting having shared prongs or side prongs that may be open or closed;

FIG. 112 shows a bracelet or choker made using the new VBS setting;

FIG. 113 shows a hoop earring made using the new VBS setting;

FIG. 114 shows different types of stones connected using the new VBS setting;

FIGS. 115, 116, and 117 shows a top view, a side view, and perspective view of a 3-stone ring using different type stones to form a new VBS setting;

FIG. 118 shows top views of a 3-stone setting using different shaped stones and using different types of stones to form a VBS setting;

FIG. 119 shows a perspective view of a stone setting in accordance with the present invention showing an engagement ring with cushion-cut stones having closed prongs;

FIG. 120 shows a perspective view of a stone setting in accordance with the present invention showing a wedding band with cushion-cut stones having closed prongs;

FIG. 121 shows a perspective view of a stone setting in accordance with the present invention showing an engagement ring with brilliant cut stones having closed prongs;

FIG. 122 shows a perspective view of a stone setting in accordance with the present invention showing a wedding band with brilliant cut stones having closed prongs;

FIG. 123 shows a perspective view of a stone setting in accordance with the present invention showing an engagement ring with assher cut stones having closed prongs;

FIG. 124 shows a perspective view of a stone setting in accordance with the present invention showing a wedding band with assher cut stones having closed prongs;

FIG. 125 shows a perspective view of a stone setting in accordance with the present invention showing an engagement ring with oval shaped stones having closed prongs;

FIG. 126 shows a perspective view of a stone setting in accordance with the present invention showing a wedding band with oval shaped stones having closed prongs;

FIG. 127 shows a perspective view of a stone setting in accordance with the present invention showing a pendant in the shape of a cross having round brilliant stones;

FIG. 128 shows a perspective view of a stone setting in accordance with the present invention showing a pendant in the shape of a cross having round brilliant stones and oval stones;

FIG. 129 shows a perspective view of a stone setting in accordance with the present invention showing a pendant in the shape of a cross having emerald cut stones and assher cut stones, which can also be made with rectangular and square radiant cut stones;

FIG. 130 shows a perspective view of a stone setting in accordance with the present invention showing a pendant in the shape of a cross having radiant stones;

FIG. 131 shows a perspective view of a stone setting in accordance with the present invention showing a pendant in the shape of a cross having asher cut stones. The cross can also be made with all cushion cut stones, all princess/square cut stones, or baguette and square cut stones;

FIG. 132 shows a perspective view of a stone setting in accordance with the present invention showing a bracelet having many different shaped stones combined. The "VBS" stone setting system of the present invention can combine all different shaped stones and all different size stones, for such settings;

FIG. 133 shows a perspective view of a stone setting in accordance with the present invention showing a clip earring or pendant having closed prongs;

FIG. 134 shows a perspective view of a stone setting in accordance with the present invention showing dangle earrings having closed prongs;

FIG. 135 shows a perspective view of a stone setting in accordance with the present invention showing rings with two or more stone settings of any size, shape, or material;

The "VBS" stone setting system of the present invention includes not only rings, but also bracelets, necklaces, and hoop earrings using the stone settings shown in FIG. 146 having closed or open prongs, and which can be stones of any size, shape, or material.

DETAILED DESCRIPTION OF THE PREFERRED EMBODIMENT PRIOR ART

Figure 1:
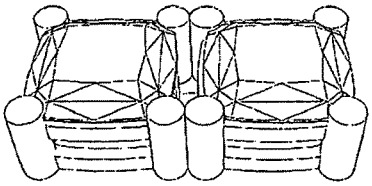
PRIOR ART FIG. 1
FIG. 1 is a perspective view of two cushion-shaped stones each with four prongs.
Figure 2:
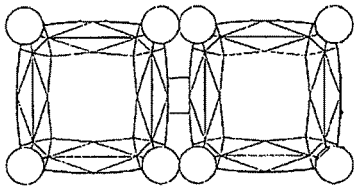
PRIOR ART FIG. 2
FIG. 2 is a top view thereof, wherein this prior art setting that shape of the stone is hidden by the prongs.
Figure 3:
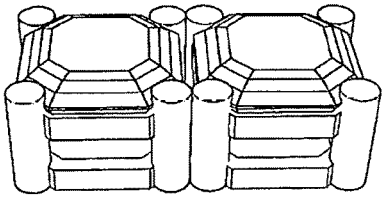
PRIOR ART FIG. 3
FIG. 3 is a perspective view of two asscher-cut stones each with four prongs.
Figure 4:
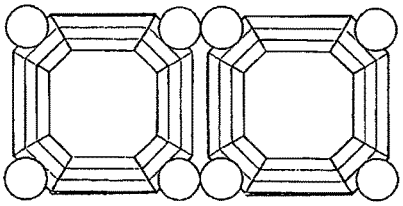
PRIOR ART FIG.4
FIG. 4 is a top view thereof, wherein this prior art setting that shape of the stone is hidden by the prongs.
Figure 5:
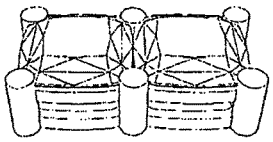
PRIOR ART FIG. 5
FIG. 5 is a perspective view of two cushion-shaped stones, showing two shared prongs.
Figure 6:
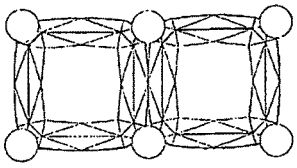
PRIOR ART FIG.6
FIG. 6 is a top view thereof.
Figure 7:
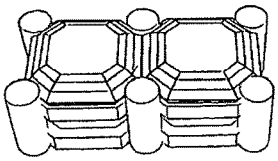
PRIOR ART FIG.7
FIG. 7 is a perspective view of two asscher-cut stones, showing two shared prongs.
Figure 8:
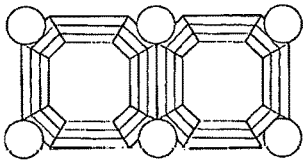
PRIOR ART FIG.8
FIG. 8 is a top view thereof.
Figure 9:
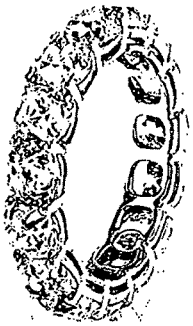
PRIOR ART FIG.9
FIG. 9 is a perspective view of a diamond ring having cushion-shaped stones set with shared prongs.
Figure 10:
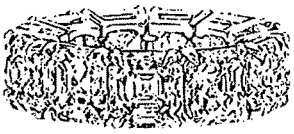
PRIOR ART FIG.10
FIG. 10 is a perspective view of a diamond ring having asscher-cut stones set with four prongs.
Figure 11:
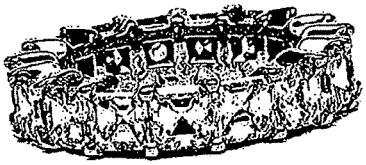
PRIOR ART FIG.11
FIG. 11 is a perspective view of a diamond ring having asscher-cut stones set with shared prongs.

FIGS. 1 to 11 are examples of existing prior art commercial settings with 4 prongs and shared prongs, which are set with cushion-shaped stones and asscher shaped stones;

The present invention provides a FIG. 1 is a perspective view of two cushion-shaped stones each with four prongs;

FIG. 2 is a top view thereof;

FIG. 3 is a perspective view of two asscher-cut stones each with four prongs;

FIG. 4 is a top view thereof;

FIG. 5 is a perspective view of two cushion-shaped stones, showing two shared prongs;

FIG. 6 is a top view thereof;

FIG. 7 is a perspective view of two asscher-cut stones, showing two shared prongs;

FIG. 8 is a top view thereof;

The following FIGS. 9 to 11 show actual photo images of settings having four prongs and shared prongs. However, it is hard to identify the shape of each stone as being an asscher-cut or a cushion-cut stone;

FIG. 9 is a perspective view of a diamond ring having cushion-shaped stones having shared prongs;

FIG. 10 is a perspective view of a diamond ring having asscher-cut stones having four prongs;

FIG. 11 is a perspective view of a diamond ring having asscher-cut stones having four shared prongs;

VBS New Stone Setting System

The VBS new stone setting system is designed and crafted to highlight the shape of the stones, and the beauty and brilliance of each and every stone, regardless of the size, shape, and material the stone is made of. This includes precious and semi-precious stones, as well as synthetic stones. The VBS settings allow the viewer to increase the visibility of each stone in order to show its unique and distinct shape. In prior art settings, these stones are typically partially blocked and obscured by the surrounding metal bands and prongs, which are found in most presently existing commercial settings. The VBS system is applied to all precious stones, including diamonds, sapphires, rubies, and emeralds; all semi-precious stones, and all synthetic stones. The stone setting of the present invention can be utilized with any shape of stone, as described herein, and it also can be used for high jewelry pieces, such as large earrings, multi-shape bracelets, crosses, and other artistic designs. In addition, the size range of the stones that may be used with the VBS system is preferably from 0.03 carats to 50.0 carats.

The stone setting of the present invention is used with any shape of stones having a size from 0.03 carats to 50.00 carats each. The stones can be of any material (precious, semiprecious, and synthetic). In a particular setting the stones can be of the same size or of different size stones to create the jewelry. Also, in any particular setting, one line of stones can be used or multiple side-by-side lines of stones can be used to create the jewelry. Also, each setting may have the same stone shapes, or different stone shapes can be used together to create the jewelry, such as using a round brilliant stone adjacent to a square princess cut. In addition, the unique stone settings of the present invention can be used to make any type of jewelry, such as rings, earrings, bracelets, or necklaces.

FIG. 12 is a top view of the new stone setting system showing two or more stones having one shared prong shared between two stones, wherein the shared prong is placed in the mid-point of the two adjacent girdles, and wherein one single prong is placed on each of the three remaining exposed sides of the stones at the mid-points of the girdle; so that each prong is placed at the north, south, east, and west of each stone, as shown, instead of at the corners of each stone.

FIG. 13 shows a multi-layer stone setting (or also called a multi-line setting), wherein the shared prong is placed in the mid-point of the adjacent girdles of each stone, and wherein the single prongs are located on the external mid-point of the girdle of each stone;

FIG. 14 is a perspective view of two stones showing an open shared prong, wherein the shared prong rises from the upper basket to the girdle to form the open shared prong;

FIG. 15 shows a perspective view of the two stones showing a closed shared prong, wherein the shared prong rises from the bottom basket to the girdle to form a closed shared prong;

FIG. 16 shows a perspective view of the two stones having open side prongs, wherein the shared prong is closed and the side prongs are open;

FIG. 17 is a top view of two round brilliant cut stones and an open shared prong between the two stone;

FIG. 18 is a front perspective view of the open shared prong, and closed side prongs;

FIG. 19 is a right side view of the opened shared prong, and the closed side prongs;

FIG. 20 is a perspective view of the two round brilliant cut stones shown in FIG. 17, having an opened shared prong between the two stones, and closed side prongs on the remaining three sides of each stone;

FIG. 21 is a perspective view of the two round brilliant cut stones, having a closed shared prong between the two stones, and closed side prongs on the remaining three sides of each stone;

FIG. 22 is a perspective view of the two round brilliant cut stones, having a closed shared prong between the two stones, and open side prongs on two sides of each stone;

FIG. 23 is a top view of two oval shaped vertical stones, having an open shared prong between the two stones, and closed side prongs on the remaining three sides of each stone;

FIG. 24 is a front view of two oval shaped stones set in a vertical layout, having an open shared prong between the two stones, and closed side prongs on the remaining three sides of each stone;

FIG. 25 is a side view of two oval shaped stones set in a vertical layout, having an open shared prong between the two stones, and closed side prongs on the remaining three sides of each stone;

FIG. 26 is a perspective view of two oval shaped stones set in a vertical layout, having an open shared prong between the two stones, and closed side prongs on the remaining three sides of each stone;

FIG. 27 is a perspective view of two oval shaped stones set in a vertical layout, having a closed shared prong between the two stones, and closed side prongs on the remaining three sides of each stone;

FIG. 28 is a perspective view of the two oval shaped stones set in a vertical layout, having a closed shared prong between the two stones, and open side prongs on two of the remaining sides of each stone;

FIG. 29 is a top view of the two oval shaped stones, having a horizontal layout, and having a closed shared prong between the two stones, and closed side prongs on the remaining three sides of each stone;

FIG. 30 is a front view of the two oval shaped stones, having a horizontal layout, and having a closed shared prong between the two stones, and closed side prongs on the remaining three sides of each stone;

FIG. 31 is a side view of the two oval shaped stones, having a horizontal layout, and having a closed shared prong between the two stones, and closed side prongs on the remaining three sides of each stone;

FIG. 32 is a perspective view of the two oval shaped stones, having a horizontal layout, and having a closed shared prong between the two stones, and closed side prongs on the remaining three sides of each stone;

FIG. 33 is a perspective view of the two oval shaped stones, having a horizontal layout, and having an open shared prong between the two stones, and closed side prongs on the remaining three sides of each stone;

FIG. 34 is a perspective view of the two oval shaped stones, having a horizontal layout, and having a closed shared prong between the two stones, and open side prongs on two of the remaining sides of each stone;

FIG. 35 is a top view of the two emerald cut stones set in a vertical layout, and having a closed shared prong between the two stones, and closed side prongs on the remaining three sides of each stone;

FIG. 36 is a front view of the two emerald cut stones set in a vertical layout, and having a closed shared prong between the two stones, and closed side prongs on the remaining three sides of each stone;

FIG. 37 is a side view of the two emerald cut stones set in a vertical layout, and having a closed shared prong between the two stones, and closed side prongs on the remaining three sides of each stone;

FIG. 38 is a perspective view of the two emerald cut stones set in a vertical layout, and having a closed shared prong between the two stones, and closed side prongs on the remaining three sides of each stone;

FIG. 39 is a perspective view of the two emerald cut stones set in a vertical layout, and having an open shared prong between the two stones, and closed side prongs on the remaining three sides of each stone;

FIG. 40 is a perspective view of the two emerald cut stones set in a vertical layout, and having a closed shared prong between the two stones, and opened side prongs on two of the remaining sides of each stone;

FIG. 41 is a top view of the two emerald cut stones set in a horizontal layout, and having an open shared prong between the two stones, and closed side prongs on the remaining three sides of each stone;

FIG. 42 is a front view of the two emerald cut stones set in a horizontal layout, and having an open shared prong between the two stones, and closed side prongs on the remaining three sides of each stone;

FIG. 43 is a side view of the two emerald cut stones set in a horizontal layout, and having an open shared prong between the two stones, and closed side prongs on the remaining three sides of each stone;

FIG. 44 is a perspective view of the two emerald cut stones set in a horizontal layout, and having an open shared prong between the two stones, and closed side prongs on the remaining three sides of each stone;

FIG. 45 is a perspective view of the two emerald cut stones set in a horizontal layout, and having a closed shared prong between the two stones, and closed side prongs on the remaining three sides of each stone;

FIG. 46 is a perspective view of the two emerald cut stones set in a horizontal layout, and having a closed shared prong between the two stones, and open side prongs on two of the remaining sides of each stone;

FIG. 47 is a top view of the two baguette shaped stones having a horizontal layout, and having an open shared prong between the two stones, and closed side prongs on the remaining three sides of each stone;

FIG. 48 is a front view of the two baguette shaped stones having a horizontal layout, and having an open shared prong between the two stones, and closed side prongs on the remaining three sides of each stone;

FIG. 49 is a side view of the two baguette shaped stones having a horizontal layout, and having an open shared prong between the two stones, and closed side prongs on the remaining three sides of each stone;

FIG. 50 is a perspective view of the two baguette shaped stones having a horizontal layout, and having an open shared prong between the two stones, and closed side prongs on the remaining three sides of each stone;

FIG. 51 is a perspective view of the two baguette shaped stones having a horizontal layout, and having a closed shared prong between the two stones, and open side prongs on the remaining three sides of each stone;

FIG. 52 is a perspective view of the two baguette shaped stones having a horizontal layout, and having a closed shared prong between the two stones, and open side prongs on two of the remaining sides of each stone;

FIG. 53 is a top view of the two baguette shaped stones having a vertical layout, and having a closed shared prong between the two stones, and closed side prongs on the remaining three sides of each stone;

FIG. 54 is a front view of the two baguette shaped stones having a vertical layout, and having a closed shared prong between the two stones, and closed side prongs on the remaining three sides of each stone;

FIG. 55 is a side view of the two baguette shaped stones having a vertical layout, and having a closed shared prong between the two stones, and closed side prongs on the remaining three sides of each stone;

FIG. 56 is a perspective view of the two baguette shaped stones having a vertical layout, and having a closed shared prong between the two stones, and closed side prongs on the remaining three sides of each stone;

FIG. 57 is a perspective view of the two baguette shaped stones having a vertical layout, and having an open shared prong between the two stones, and closed side prongs on the remaining three sides of each stone;

FIG. 58 is a perspective view of the two baguette shaped stones having a vertical layout, and having a closed shared prong between the two stones, and open side prongs on two of the remaining sides of each stone;

FIG. 59 is a top view of the two asscher-cut stones having a closed shared prong between the two stones, and closed side prongs on the remaining three sides of each stone;

FIG. 60 is a front view of the two asscher-cut stones having a closed shared prong between the two stones, and closed side prongs on the remaining three sides of each stone;

FIG. 61 is a side view of the two asscher-cut stones having a closed shared prong between the two stones, and closed side prongs on the remaining three sides of each stone;

FIG. 62 is a perspective view of the two asscher-cut stones having a closed shared prong between the two stones, and closed side prongs on the remaining three sides of each stone;

FIG. 63 is a perspective view of the two asscher-cut stones having an open shared prong between the two stones, and closed side prongs on the remaining three sides of each stone;

FIG. 64 is a perspective view of the two asscher-cut stones having a closed shared prong between the two stones, and open side prongs on two of the remaining sides of each stone;

FIG. 65 is a top view of the two cushion shaped stones having an open shared prong between the two stones, and closed side prongs on the remaining three sides of each stone;

FIG. 66 is a front view of the two cushion shaped stones having an open shared prong between the two stones, and closed side prongs on the remaining three sides of each stone;

FIG. 67 is a side view of the two cushion shaped stones having an open shared prong between the two stones, and closed side prongs on the remaining three sides of each stone;

FIG. 68 is a perspective view of the two cushion shaped stones having an open shared prong between the two stones, and closed side prongs on the remaining three sides of each stone;

FIG. 69 is a perspective view of the two cushion shaped stones having a closed shared prong between the two stones, and closed side prongs on the remaining three sides of each stone;

FIG. 70 is a perspective view of the two cushion shaped stones having a closed shared prong between the two stones, and open side prongs on two of the remaining sides of each stone;

FIG. 71 is a top view of the two radiant cut stones having an open shared prong between the two stones, and closed side prongs on the remaining three sides of each stone;

FIG. 72 is a front view of the two radiant cut stones having an open shared prong between the two stones, and closed side prongs on the remaining three sides of each stone;

FIG. 73 is a side view of the two radiant cut stones having an open shared prong between the two stones, and closed side prongs on the remaining three sides of each stone;

FIG. 74 is a perspective view of the two radiant cut stones having an open shared prong between the two stones, and closed side prongs on the remaining three sides of each stone;

FIG. 75 is a perspective view of the two radiant cut stones having a closed shared prong between the two stones, and closed side prongs on the remaining three sides of each stone;

FIG. 76 is a perspective view of the two radiant cut stones having a closed shared prong between the two stones, and open side prongs on two of the remaining sides of each stone;

FIG. 77 is a top view of two princess cut/square shape stones having a closed shared prong between the two stones, and closed side prongs on the remaining three sides of each stone;

FIG. 78 is a front view of two princess cut/square shape stones having a closed shared prong between the two stones, and closed side prongs on the remaining three sides of each stone;

FIG. 79 is a side view of two princess cut/square shape stones having a closed shared prong between the two stones, and closed side prongs on the remaining three sides of each stone;

FIG. 80 is a perspective view of two princess cut/square shape stones having a closed shared prong between the two stones, and closed side prongs on the remaining three sides of each stone;

FIG. 81 is a perspective view of two princess cut/square shape stones having an open shared prong between the two stones, and closed side prongs on the remaining three sides of each stone;

FIG. 82 is a perspective view of two princess cut/square shape stones having a closed shared prong between the two stones, and open side prongs on two of the remaining sides of each stone;

The following Figures show engagement rings, wedding bands, tennis bracelets, necklaces, and hoop earrings, which may be made of precious, semi-precious, or synthetic stones, of any type of stone cut, such as emerald, asscher, cushion, oval, round brilliant, baguette, radiant, square cut, princess cut, or any other shape stones, having a size from 0.03 carats to 50.0 carats each;

FIG. 83 is a top view of the new stone setting system for rings, bands, bracelets, necklaces, and earrings with 3 or more stones having round brilliant cut stones have open or closed shared prongs between the stones, and side prongs that are open or closed;

FIG. 84 is a top view of the new stone setting system for rings, bands, bracelets, necklaces, and earrings with 3 or more stones having emerald cut stones having a horizontal layout, and having open or closed shared prongs between the stones, and side prongs that are open or closed;

FIG. 85 is a top view of the new stone setting system for rings, bands, bracelets, necklaces, and earrings with 3 or more stones having emerald cut stones having a vertical layout, and having open or closed shared prongs between the stones, and side prongs that are open or closed;

FIG. 86 is a top view of the new stone setting system for rings, bands, bracelets, necklaces, and earrings with 3 or more stones having cushion cut stones have open or closed shared prongs between the stones, and side prongs that are open or closed;

FIG. 87 is a top view of the new stone setting system for rings, bands, bracelets, necklaces, and earrings with 3 or more stones having baguette stones having a horizontal layout, and having open or closed shared prongs between the stones, and side prongs that are open or closed;

FIG. 88 is a top view of the new stone setting system for rings, bands, bracelets, necklaces, and earrings with 3 or more stones having baguette stones having a vertical layout, and having open or closed shared prongs between the stones, and side prongs that are open or closed;

FIG. 89 is a top view of the new stone setting system for rings, bands, bracelets, necklaces, and earrings with 3 or more stones having radiant cut stones have open or closed shared prongs between the stones, and side prongs that are open or closed;

FIG. 90 is a top view of the new stone setting system for rings, bands, bracelets, necklaces, and earrings with 3 or more stones having oval shaped stones having a horizontal layout, and having open or closed shared prongs between the stones, and side prongs that are open or closed;

FIG. 91 is a top view of the new stone setting system for rings, bands, bracelets, necklaces, and earrings with 3 or more stones having oval shaped stones having a vertical layout, and having open or closed shared prongs between the stones, and side prongs that are open or closed;

FIG. 92 is a top view of the new stone setting system for rings, bands, bracelets, necklaces, and earrings with 3 or more stones having asscher-cut stones have open or closed shared prongs between the stones, and side prongs that are open or closed;

FIG. 93 is a top view of the new stone setting system for rings, bands, bracelets, necklaces, and earrings with 3 or more stones having princess square cut stones, and having open or closed shared prongs between the stones, and side prongs that are open or closed;

FIGS. 94, 95, and 96 show photos of actual samples of rings using the new VBS setting on bracelets having shared prongs that are open or closed between the stones, and side prongs on the stones that are open or closed;

FIG. 97 shows a tennis bracelet having round brilliant stones with shared prongs and side prongs that are open or closed;

FIG. 98 shows a tennis necklace having square radiant stones with shared prongs and side prongs that are open or closed;

FIG. 99 shows hoop earrings having round brilliant stones with shared prongs and side prongs that are open or closed;

FIG. 100 shows groups of multiple stones of different sizes connected to form settings for any type of jewelry using different shaped stones having shared and side prongs that are open or closed. The "VBS" stone setting system of the present invention can combine all different shaped stones and all different size stones, for such settings;

FIGS. 101, 102, and 103 show a ring having graduated emerald cut stones in a top view, side view, and a perspective view having shared prongs that can be open or closed, and side prongs that are open or closed. These stones can be of any shapes and of any material, and are of the size range of 0.05 carats to 50.0 carats;

FIG. 104 shows a tennis bracelet having graduated cushion stones having shared prongs that can be open or closed, and side prongs that are open or closed. Stones set in this bracelet can be in any shapes, and any material, and are of the size range of 0.05 carats to 50.0 carats each;

FIG. 105 shows hoop earrings having graduated round brilliant stones having shared prongs that can be open or closed, and side prongs that are open or closed. Stones set in these earrings can be in any shapes, and any material, and are of the size range of 0.05 carats to 50.0 carats each;

FIG. 106 shows a necklace having different size stones connected to form a VBS setting having shared and side prongs that are open or closed. Stones set in this necklace can be in any shapes, and any material, and are of the size range of 0.05 carats to 50.0 carats each;

FIG. 107 shows groups of five stones of different shapes connected to form a VBS setting, and also shows different types of stones to form the settings, having shared and side openings that are open or closed. Graduating stones of any size or shape may be used to create these necklaces;

The following Figures show rings, bracelets, necklaces, and hoop earrings with multi-layered stones (also known as multi-lines of stone settings), wherein the rings can be made of any material, such as precious, semi-precious, or synthetic stones, or any shape of stones, or of any type of stone cut, such as emerald, asscher, cushion, oval, round brilliant, baguette, radiant, square cut, princess cut, or any other shape stones, having a size from 0.03 carats to 50.0 carats each;

FIGS. 108, 109, 110, and 111 show a top view, a front view, a side view and a perspective view of a ring (which can also be a necklace, or a hoop earring, or a bracelet), with square radiant stones connected to form a new VBS setting having shared prongs or side prongs that may be open or closed;

FIG. 112 shows a bracelet or choker made using the new VBS setting;

FIG. 113 shows a hoop earring made using the new VBS setting;

FIG. 114 shows different types of stones in a multi-layer layout connected using the new VBS setting. The stones can be in any shapes, and any of material, and are of the size range of 0.05 carats to 50.0 carats. This system can be used to create rings, bracelets, necklaces and earrings;

FIGS. 115, 116, and 117 shows a top view, a side view, and perspective view of a 3-stone ring using different type stones to form a new VBS setting;

FIG. 118 shows top views of a 3-stone setting using different shaped stones and using different types of stones to form a VBS setting;

FIG. 119 shows a perspective view of a stone setting in accordance with the present invention showing an engagement ring with cushion-cut stones having closed prongs;

FIG. 120 shows a perspective view of a stone setting in accordance with the present invention showing a wedding band with cushion-cut stones having closed prongs;

FIG. 121 shows a perspective view of a stone setting in accordance with the present invention showing an engagement ring with brilliant cut stones having closed prongs;

FIG. 122 shows a perspective view of a stone setting in accordance with the present invention showing a wedding band with brilliant cut stones having closed prongs;

FIG. 123 shows a perspective view of a stone setting in accordance with the present invention showing an engagement ring with asher cut stones having closed prongs;

FIG. 124 shows a perspective view of a stone setting in accordance with the present invention showing a wedding band with asher cut stones having closed prongs;

FIG. 125 shows a perspective view of a stone setting in accordance with the present invention showing an engagement ring with oval shaped stones having closed prongs;

FIG. 126 shows a perspective view of a stone setting in accordance with the present invention showing a wedding band with oval shaped stones having closed prongs;

FIG. 127 shows a perspective view of a stone setting in accordance with the present invention showing a pendant in the shape of a cross having round brilliant stones;

FIG. 128 shows a perspective view of a stone setting in accordance with the present invention showing a pendant in the shape of a cross having round brilliant stones and oval stones;

FIG. 129 shows a perspective view of a stone setting in accordance with the present invention showing a pendant in the shape of a cross having emerald cut stones and asher cut stones, which can also be made with rectangular and square radiant cut stones;

FIG. 130 shows a perspective view of a stone setting in accordance with the present invention showing a pendant in the shape of a cross having radiant stones;

FIG. 131 shows a perspective view of a stone setting in accordance with the present invention showing a pendant in the shape of a cross having asher cut stones. The cross can also be made with all cushion cut stones, all princess/square cut stones, or baguette and square cut stones;

FIG. 132 shows a perspective view of a stone setting in accordance with the present invention showing a bracelet having many different shaped stones combined. The "VBS" stone setting system of the present invention can combine all different shaped stones and all different size stones, for such settings;

FIG. 133 shows a perspective view of a stone setting in accordance with the present invention showing a clip earring or pendant having closed prongs;

FIG. 134 shows a perspective view of a stone setting in accordance with the present invention showing dangle earrings having closed prongs;

FIG. 135 shows a perspective view of a stone setting in accordance with the present invention showing rings with two or more stone settings of any size, shape, or material;

The "VBS" stone setting system of the present invention includes not only rings, but also bracelets, necklaces, and hoop earrings using the stone settings shown in FIG. 146 having closed or open prongs, and which can be stones of any size, shape, or material.

Advantages of the Present Invention

It is an advantage of the invention to provide an improved jewelry stone setting system.

It is another advantage of the invention to provide a shared prong between adjacent stones at their mid-point, so that adjacent stones are more visible to the wearer and the viewer.

It is a further advantage of the invention to provide a side prong at the mid-point of the side of each stone, so that adjacent stones are more visible to the wearer and the user.

It is a further advantage of the invention to provide a setting, which can be used with any type of stone, such as cushion stones, asscher stones, round brilliant stones, oval stones, emerald cut stones, baguette shaped stones, radiant cut stones, princess cut stones and any shape of stones.

It is a further advantage of the invention to provide a setting which can be used with any size stone in the range of 0.03 carats to 50.0 carats, any shape of stone, and made of any material.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A jewelry stone setting system, comprising:

a plurality of stones each having at least one shared side connected to an adjacent stone of the plurality of stones to form a setting, each of the plurality of stones having a girdle;

a plurality of baskets, each basket extending around one stone of the plurality of stones;

a non-removable single shared prong placed between adjacent stones of the plurality of stones at a first mid-point of the girdles of the adjacent stones, the first mid-point of the girdles being the mid-point of the portions of the girdles facing the adjacent stone; and a plurality of non-removable single side prongs, each single side prong being placed at an outer exposed side of the plurality of stones at a second mid-point of the girdle thereof, the second mid-point of the girdle being the mid-point of the portion of the girdle facing the outer exposed side.

2. The jewelry stone setting system of claim 1, wherein the plurality of baskets comprise a plurality of upper baskets, each upper basket extending around one stone of the plurality of stones.

3. The jewelry stone setting system of claim 2, wherein the shared prong extends from an upper basket of the plurality of upper baskets to the girdle of the stone around which the upper basket extends.

4. The jewelry stone setting system of claim 2, wherein at least one side prong of the plurality of non-removable single side prongs extends from an upper basket of the plurality of upper baskets to the girdle of the stone around which the upper basket extends.

5. The jewelry stone setting system of claim 2, wherein the plurality of baskets comprise a plurality of bottom baskets, each bottom basket extending around one stone of the plurality of stones.

6. The jewelry stone setting system of claim 5, wherein the shared prong extends from a bottom basket of the plurality of upper baskets to the girdle of the stone around which the bottom basket extends.

7. The jewelry stone setting system of claim 5, wherein at least one side prong of the plurality of non-removable single side prongs extends from a bottom basket of the plurality of bottom baskets to the girdle of the stone around which the bottom basket extends.

8. The jewelry stone setting system of claim 1, wherein the plurality of stones includes at least one stone having a shape of at least one of cushion stones, asscher cut stones, rectangular brilliant stones, oval stones, emerald cut stones, baguette shaped stones, radiant cut stones, and princess cut stones.

9. The jewelry stone setting system of claim 1, wherein two adjacent stones of the plurality of stones have a different shape from each other.

10. The jewelry stone setting system of claim 1, wherein the plurality of stones include stones having a size in a range of 0.03 carats to 50.00 carats.

11. The jewelry stone setting system of claim 1, wherein two adjacent stones of the plurality of stones have a different size from each other.

12. The jewelry stone setting system of claim 1, wherein the plurality of stones includes a row of stones, adjacent stones of the plurality of stones being connected by shared sides, each stone having at least two opposing outer exposed sides, wherein a single shared prong is placed between each adjacent stone at the first mid-point of the girdles of the adjacent stones, and wherein a single side prong is placed at each outer exposed side of the plurality of stones at the second mid-point of the girdles thereof.

13. The jewelry stone setting system of claim 1, wherein the plurality of stones include a plurality of rows of stones, adjacent stones of the plurality of stones from different rows being connected by shared sides, wherein a single shared prong is placed between adjacent stones at the first mid-point of the girdles of the adjacent stones, and wherein a single side prong is placed at each outer exposed side of the plurality of stones at the second mid-point of the girdles thereof.

14. The jewelry stone setting system of claim 1, wherein the plurality of stones include a plurality of rows of stones, adjacent stones of the plurality of stones from different rows being not being directly connected, each stone having at least two opposing outer exposed sides, wherein a single shared prong is placed between each adjacent stone at the first mid-point of the girdles of the adjacent stones, and wherein a single side prong is placed at each outer exposed side of the plurality of stones at the second mid-point of the girdles thereof.

15. A jewelry stone setting system, comprising:

a plurality of stones, each having at least one shared side connected to an adjacent stone of the plurality of stones to form a setting, each of the plurality of stones having a girdle;

a plurality of upper baskets, each upper basket being positioned below the girdle of a respective stone, each upper basket forming a perimeter around the respective stone in the same shape as the girdle of the respective stone;

a plurality of bottom baskets, each bottom basket being positioned below a respective upper basket with a gap therebetween, each bottom basket forming a perimeter in the same shape as the respective upper basket;

a non-removable single shared prong placed between adjacent stones of the plurality of stones at a first mid-point of the girdles of the adjacent stones, the first mid-point of the girdles being the mid-point of the portions of the girdles facing the adjacent stone, wherein the single shared prong extends from the upper basket to the girdle; and a plurality of non-removable single side prongs, each single side prong being placed at an outer exposed side of the plurality of stones at a second mid-point of the girdle thereof, the second mid-point of the girdle being the mid-point of the portion of the girdle facing the outer exposed side, wherein the single side prong extends from the upper basket to the girdle, wherein at least one prong of the single shared prong and the plurality of single side prongs further extends from the bottom basket to the upper basket.

* * * * *